US008287090B2

(12) United States Patent
Kanda et al.

(10) Patent No.: US 8,287,090 B2
(45) Date of Patent: Oct. 16, 2012

(54) INKJET PRINTING APPARATUS AND INKJET PRINTING METHOD

(75) Inventors: Hidehiko Kanda, Yokohama (JP); Jiro Moriyama, Kawasaki (JP); Atsuhiko Masuyama, Yokohama (JP); Masahiko Umezawa, Kawasaki (JP); Hideaki Takamiya, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 450 days.

(21) Appl. No.: 12/549,059

(22) Filed: Aug. 27, 2009

(65) Prior Publication Data

US 2009/0309907 A1 Dec. 17, 2009

Related U.S. Application Data

(63) Continuation of application No. 12/099,846, filed on Apr. 9, 2008, now Pat. No. 7,591,532.

(30) Foreign Application Priority Data

Apr. 11, 2007 (JP) ..... 2007-104210

(51) Int. Cl.
*B41J 2/15* (2006.01)

(52) U.S. Cl. ..... 347/41

(58) Field of Classification Search ..... 347/4–5, 347/15, 16, 41

See application file for complete search history.

(56) References Cited

U.S. PATENT DOCUMENTS

| | | | | |
|---|---|---|---|---|
| 4,999,646 | A * | 3/1991 | Trask | 347/41 |
| 6,003,972 | A * | 12/1999 | Narushima | 347/43 |
| 6,375,307 | B1 | 4/2002 | Vinals et al. | |
| 6,695,432 | B2 * | 2/2004 | Kanda | 347/41 |
| 2009/0040550 | A1 | 2/2009 | Marumoto et al. | |

FOREIGN PATENT DOCUMENTS

| | | |
|---|---|---|
| JP | 60-107975 A | 6/1985 |
| JP | 61-121658 A | 6/1986 |

* cited by examiner

*Primary Examiner* — Lamson Nguyen
(74) *Attorney, Agent, or Firm* — Fitzpatrick, Cella, Harper & Scinto

(57) ABSTRACT

This invention reduces an unprinted stripe occurred by edge deviation of a printhead. An inkjet printing apparatus according to this invention can execute a first printing mode in which an image is printed by scanning the printhead in a first region on the printing medium N times and scanning the printhead in a second region adjacent to the first region (N+1) times, and a second mode in which an image is printed by scanning the printhead in the first region M times and scanning the printhead in the second region (M+1) times. The width, in the conveyance direction of the printing medium, of the second region printed in the second printing mode is narrower than the width, in the conveyance direction of the printing medium, of the second region printed in the first printing mode.

6 Claims, 18 Drawing Sheets

INKJET PRINTING APPARATUS AND INKJET PRINTING METHOD

CROSS REFERENCE TO RELATED APPLICATION

This application is a continuation application of U.S. patent application Ser. No. 12/099,846, filed Apr. 9, 2008, the entire disclosure of which is incorporated herein by reference.

BACKGROUND OF THE INVENTION

1. Field of the Invention

The present invention relates to an inkjet printing apparatus and inkjet printing method which print by discharging ink from a printhead onto a printing medium.

2. Description of the Related Art

There are various kinds of printing apparatuses such as image print apparatus of, e.g., a printer, copying machine, and facsimile, a multifunction electronic apparatus including, e.g., a computer and word processor, and a print output apparatus of, e.g., a workstation. These printing apparatuses print images and the like on printing media such as printing paper and a thin plastic plate based on image information (containing all output information such as text information).

Such printing apparatuses can be classified into, e.g., the inkjet scheme, wire dot scheme, thermal scheme, and laser beam scheme in accordance with their printing methods. A printing apparatus (to be referred to as an inkjet printing apparatus hereinafter) of the inkjet scheme prints by discharging ink from a printhead onto a printing medium. The inkjet printing apparatus has various advantages of easy high-precision printing, high-speed printing, excellent quietness, and low cost as compared with the other printing schemes. Along with the recent increase in the importance of a color output such as a color image, a variety of color inkjet printing apparatuses which attain high quality comparable even to that of a silver halide photograph are under development.

To improve the printing speed, a general inkjet printing apparatus of this type uses a plurality of printheads (multiheads) which are formed by integrating a plurality of printing elements including, for example, ink discharge orifices and ink channels and are compatible with color printing.

FIG. 1 shows the arrangement of an inkjet printing apparatus which prints using the above-described multiheads. Referring to FIG. 1, ink cartridges 101 include printheads 102 serving as multiheads and ink tanks containing inks of four colors, black, cyan, magenta, and yellow. FIG. 2 shows ink discharge orifices arrayed on the printhead 102 when seen from the Z direction. n ink discharge orifices 201 which constitute a printing element are arrayed on the printhead 102 with a density of N dots per inch (N dpi). Referring back to FIG. 1, a conveyance roller 103 rotates in a direction indicated by an arrow in FIG. 1 while holding down a printing medium P together with an auxiliary roller 104, thereby conveying the printing medium P in the Y direction as needed. A feeding roller 105 feeds a printing medium P and also serves to hold down the printing medium P, like the conveyance roller 103 and auxiliary roller 104. A carriage 106 supports the four ink cartridges 101 and moves them as printing progresses. When, for example, printing is not performed or the printhead 102 undergoes a recovery operation, the carriage 106 stands by at a home position h indicated by a dotted line in FIG. 1.

Upon receiving a printing start instruction, the carriage 106 which has been at the home position h before the start of printing moves in the X direction. During this movement, the n ink discharge orifices 201 arrayed on the printhead 102 with N dpi print an image pattern with a width of n/N inches on a printing medium P. After the printing of the trailing edge of the printing medium P is completed, the carriage 106 returns to the original home position h and performs printing scanning in the x direction again. Before the start of the second printing after the completion of the first printing, the conveyance roller 103 rotates in the direction indicated by the arrow to convey the printing medium P in the Y direction by a width of n/N inches. For each scanning of the carriage 106, the printing of an image pattern with a width of n/N inches by the printhead 102 and the conveyance by the same width are repeated. This makes it possible to complete the printing of an image corresponding to, for example, one page. Such a printing mode in which an image is printed by performing printing scanning in the same printing region once is called a one-pass printing mode.

The one-pass printing mode is suitable for high-speed image printing. However, a few small errors are sometimes occurred in this mode generally due to a conveyance operation by a conveyance mechanism. FIGS. 3A to 3C each illustrate a printing example in which an error (conveyance error) is occurred due to the conveyance operation. FIG. 3A illustrates a case in which the conveyance is performed ideally. FIG. 3B illustrates a case in which a gap is formed with a width S because the contact portion between dots printed by the Kth scanning and (K+1)th scanning is discontinuous. If a gap with a width S is occurred due to a conveyance error as in this case, an unprinted stripe with a width S appears in the scanning direction of the printhead, resulting in a decrease in the quality of a printed image. As an example of a measure against this problem, Japanese Patent Laid-open No. S61-121658 discloses a method of printing by matching image regions in the contact portion between successive scanning operations and complementing the matched image regions with each other by these scanning operations, as shown in FIG. 3C.

The quality of a printed image decreases due to an unprinted stripe occurred in the contact portion not only when a conveyance error is occurred but also when ink droplets discharged from the printhead do not scatter straightly. U.S. Pat. No. 6,375,307 discloses an example of a measure against a decrease in the quality of a printed image as in this case.

High-quality image printing involves various factors such as the color development, tonality, and uniformity. In particular, the uniformity readily decreases when a slightest manufacturing variation unique to each nozzle occurs in a multihead manufacturing process. This variation adversely affects the discharge amount and discharge direction of ink from each nozzle in printing and finally causes density unevenness of a printed image.

A detailed example of this phenomenon will be explained with reference to FIGS. 4A to 4C and 5A to 5C. Referring to FIG. 4A, a printhead 102 includes eight ink discharge orifices 201. Ideally, ink droplets 43 are normally discharged from the ink discharge orifices 201 by the same amount and in the same direction, as shown in FIG. 4A. Discharge in this way forms dots with the same size in a uniform array pattern on a printing medium, as shown in FIG. 4B. A uniform image free from any density unevenness as a whole is thus obtained, as shown in FIG. 4*c*.

However, individual nozzles actually have manufacturing variations as described above. When printing is performed in the one-pass printing mode, the sizes and discharge directions of ink droplets discharged from the ink discharge orifices vary, as shown in FIG. 5A. These ink droplets land on a printing medium, as shown in FIG. 5B. Referring to FIG. 5B, unprinted portions and, conversely, excessively superimposed dots extend in the scanning direction (the horizontal direction in FIG. 5B) of the printhead. An unprinted stripe is also occurred around the center in FIG. 5B. Portions printed in this state have a density distribution as shown in FIG. 5C in the array direction of the ink discharge orifices, and therefore are detected as density unevennesses. A stripe (contact stripe) formed in the contact portion between successive scanning operations often becomes conspicuous due to a variation in the amount of conveyance.

As a measure against these density unevenness and contact stripe, Japanese Patent Laid-open No. S60-107975 discloses the following method for a monochrome inkjet printing apparatus. This method will be briefly explained with reference to FIGS. 5A to 5C and 6A to 6C. This method scans the printhead 102 three times to complete the printing of printing regions shown in FIGS. 5B and 6B (FIG. 6A). The printing of a four-pixel region corresponding to 1/2 each printing region is completed by two-pass printing. In this case, the eight nozzles of the printhead 102 are divided into two groups, that is, four upper nozzles and four lower nozzles in FIG. 5A. Dots printed by the first scanning using each nozzle are thus thinned out to about 1/2. The remaining half dots complementary to the dots printed by the first scanning are printed by the second scanning to complete the printing of a four-pixel region. The above-described printing mode will be referred to as a multipass printing mode hereinafter.

The use of this multipass printing mode allows reduction of the adverse influence of a manufacturing variation unique to each nozzle on a printed image by half even when the printhead shown in FIG. 5A is used. A printed image as shown in FIG. 6B is thus obtained. In this image, an unprinted stripe and overprinted stripe (stripes occurred upon superimposition of dots) as shown in FIG. 5B are less conspicuous. A uniform density distribution as shown in FIG. 6C is thus obtained. In this density distribution, density unevenness is considerably small as compared with that caused in the one-pass printing mode. In this multipass printing mode, image data is divided and printed so that the image data printed by the first scanning and second scanning complement each other in accordance with a predetermined array pattern. The most common mask pattern used to divide this image data is the one which prints a staggered pattern in the vertical and horizontal directions pixel by pixel, as shown in FIGS. 7A to 7C. The printing of a unit printing region (a four-pixel region in this case) is completed by the first scanning for printing a staggered pattern and by the second scanning for printing a pattern complementary to that printed by the first scanning. FIGS. 7A to 7C explain how to complete the printing of a predetermined region when a mask pattern printed in this way is used by taking a case in which a multihead having eight nozzles is used as in FIGS. 4A to 6C as an example.

First, in the first scanning, a staggered pattern is printed on a printing medium using the four lower nozzles shown in FIG. 5A (FIG. 7A). Next, in the second scanning, the printing medium is conveyed by four pixels (1/2 the length of the printhead), and image data complementary to that printed by the first scanning is printed (FIG. 7B). Lastly, in the third scanning, the printing medium is further conveyed by four pixels again, and printed in the same manner as in the first scanning (FIG. 7C). The conveyance by four pixels and the printing of complementary staggered patterns are alternately repeated in this way, thereby completing the printing of a four-pixel region for each scanning. As described above, when the printing of the same printing region is completed using two different nozzles, it is possible to obtain a high-quality image free from any density unevenness.

Unfortunately, the conventional inkjet printing scheme poses the following problems. To obtain a high-quality image at high speed, it is necessary to discharge small liquid droplets with high frequency. This occurs a stripe as in the printing result shown in FIG. 8. A stripe of this type is particularly occurred in a region with high dot density (high printing duty), such as the contact portion between successive scanning operations of the printhead.

The cause of this phenomenon will be explained with reference to FIG. 9. FIG. 9 is a view showing the state in which the printhead 102 discharges ink droplets in printing the printing result shown in FIG. 8. FIG. 9 shows the state in which all of a plurality of nozzles (e.g., 256 nozzles) of a printhead discharge ink droplets, that is, the state in which printing is performed with a printing duty of 100%. Ink droplets discharged from nozzles in the edge portions of the nozzle array scatter inward with respect to the nozzle array. This is because all the nozzles discharge ink with high frequency and the air surrounding the discharged ink droplets migrates in the same direction, so the air pressure is reduced. This produces an air current in which the air outside the reduced pressure portion migrates toward it, and therefore the ink droplets discharged from the nozzles in the edge portions curve inward. In this specification, this phenomenon will be referred to as edge deviation hereinafter. When this edge deviation occurs, the landing positions of dots formed by the ink droplets discharged from the nozzles in the edge portions of the nozzle array shift, resulting in a stripe as in the printing result shown in FIG. 8.

To avoid this edge deviation, the volumes of discharged ink droplets may be increased. This makes it possible to suppress the adverse influence of an air current produced under a reduced pressure on a printed image. However, as the volumes of discharged ink droplets increase, ink dots become conspicuous in a printed image, resulting in degradation in image quality. Although edge deviation can be reduced by decreasing the discharge frequency, the number of nozzles, or the density of nozzles, the printing speed drops. Still worse, change in the printhead arrangement may increase the manufacturing cost.

This edge deviation depends on the density (printing duty) of dots printed by one scanning operation. For this reason, edge deviation occurs not only in printing in the one-pass printing mode as shown in FIG. 8 but also in printing in the multipass printing mode.

SUMMARY OF THE INVENTION

The present invention is directed to an inkjet printing apparatus and inkjet printing method.

It is an object of the present invention to provide an inkjet printing apparatus and inkjet printing method which minimize the occurrence of an unprinted stripe due to edge deviation.

According to one aspect of the present invention, preferably, there is provided an inkjet printing apparatus comprising:

printing means for printing by scanning a printhead to discharge ink on a printing medium; and conveyance means for conveying the printing medium at an interval between successive scanning operations of the printhead, wherein a first printing mode in which an image is printed by scanning the printhead in a first region on the printing medium N times (N is an integer not less than 1) and scanning the printhead in a second region adjacent to the first region (N+1) times, and a second mode in which an image is printed by scanning the printhead in the first region M times (M is an integer not less than 2, and M>N) and scanning the printhead in the second region (M+1) times can be executed, and a width, in a conveyance direction of the printing medium, of the second region printed in the second printing mode is narrower than the width, in the conveyance direction of the printing medium, of the second region printed in the first printing mode.

According to another aspect of the present invention, preferably, there is provided an inkjet printing method comprising the steps of:

printing by scanning a printhead to discharge ink on a printing medium;

conveying the printing medium at an interval between successive scanning operations of the printhead; and executing one of a first printing mode in which an image is printed by scanning the printhead in a first region on the printing medium N times (N is an integer not less than 1) and scanning the printhead in a second region adjacent to the first region (N+1) times, and a second mode in which an image is printed by scanning the printhead in the first region M times (M is an integer not less than 2, and M>N) and scanning the printhead in the second region (M+1) times, wherein a width, in a conveyance direction of the printing medium, of the second region printed in the second printing mode is narrower than the width, in the conveyance direction of the printing medium, of the second region printed in the first printing mode.

The present invention is particularly advantageous since it can provide an inkjet printing apparatus and inkjet printing method which minimize the occurrence of an unprinted stripe due to edge deviation. These inkjet printing apparatus and inkjet printing method also allow high-quality, high-speed image printing.

Further features of the present invention will become apparent from the following description of exemplary embodiments (with reference to the attached drawings).

DESCRIPTION OF THE EMBODIMENTS

Embodiments of the present invention will be described below with reference to the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Figure 1:
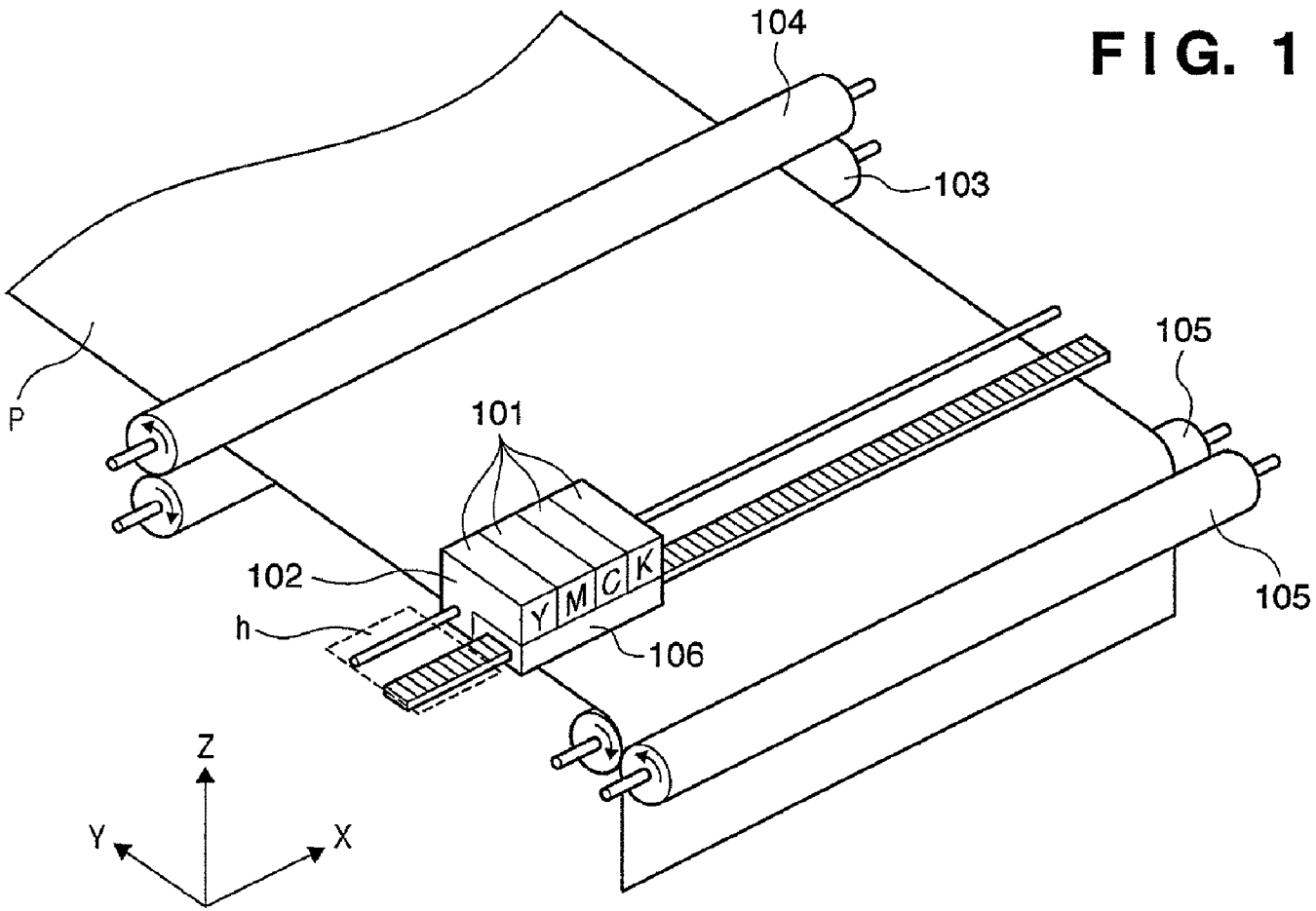
FIG. 1 is a schematic explanatory view showing an inkjet printing apparatus to which the present invention is applicable.
Figure 2:
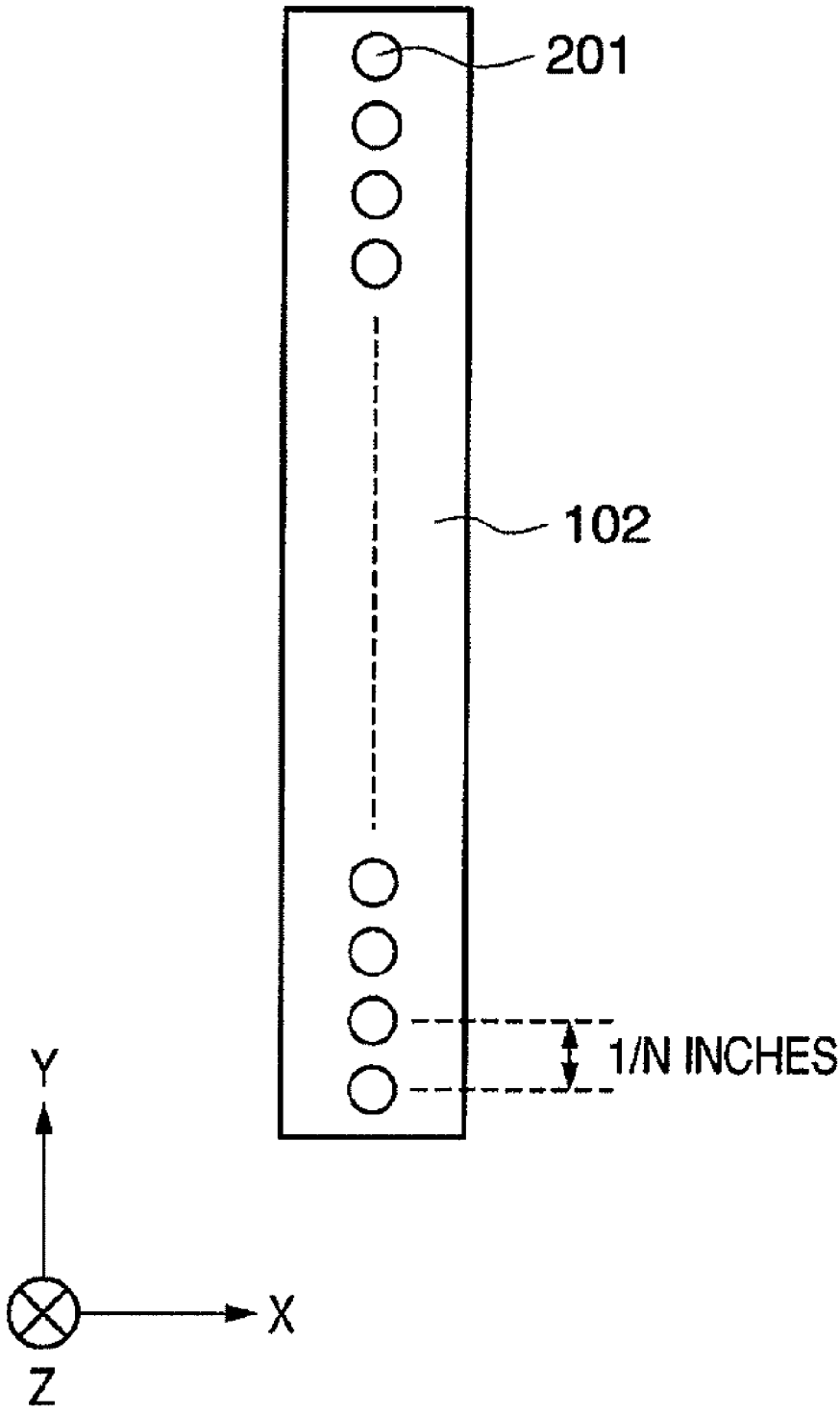
FIG. 2 is a partial explanatory view showing a printhead to which the present invention is applicable.

The following embodiments adopt a printhead having an array of a plurality of printing elements shown in FIG. 2. The following embodiments also adopt an inkjet printing apparatus having a carriage which scans a printhead in a direction which intersects the array direction of the printing element array shown in FIG. 1.

The control arrangement of an inkjet printing apparatus according to a preferred embodiment of the present invention will be explained first.

Figure 10:
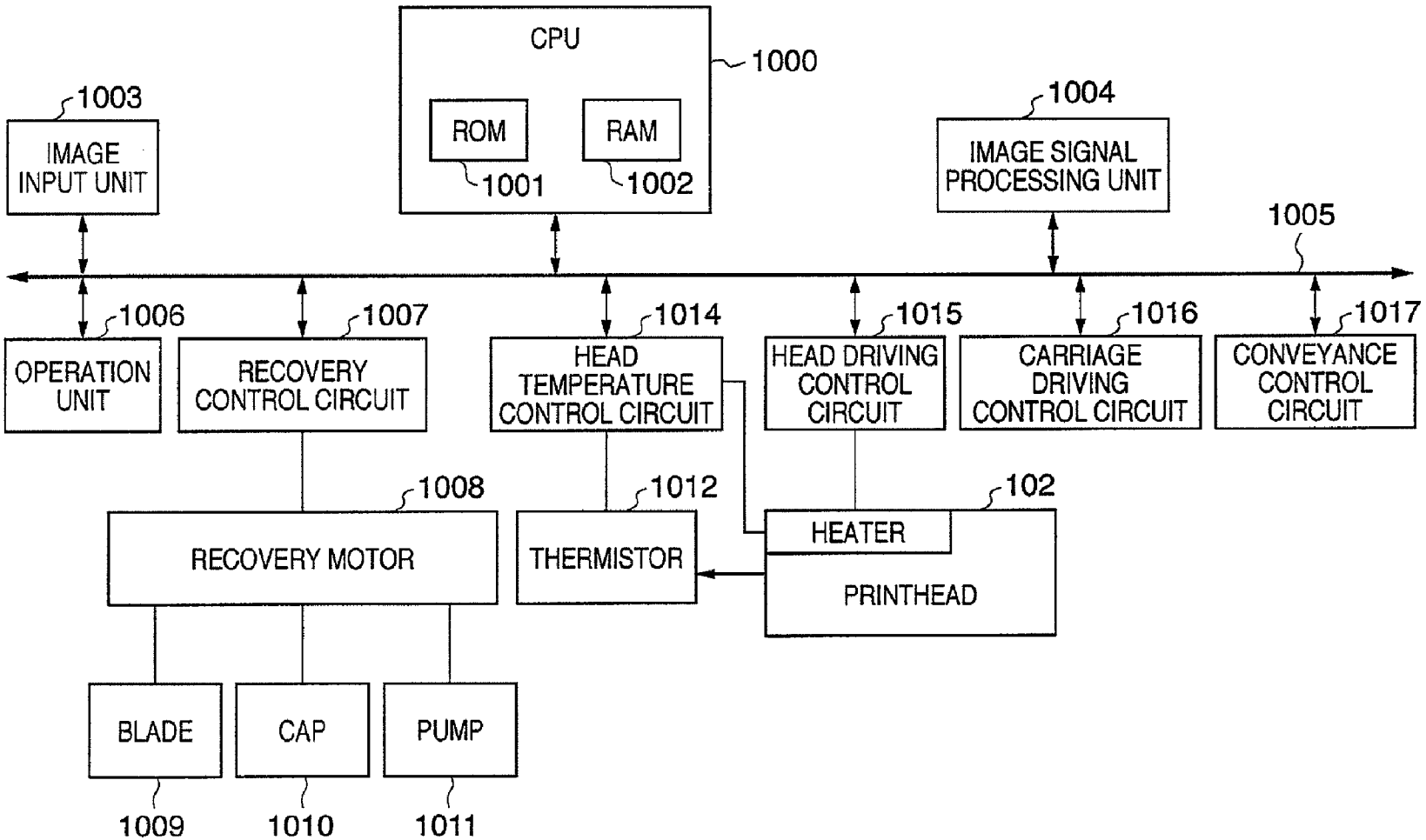
FIG. 10 is a block diagram showing the control arrangement of an inkjet printing apparatus to which the present invention is applicable.

FIG. 10 is a block diagram showing the control arrangement of an inkjet printing apparatus.

Referring to FIG. 10, the inkjet printing apparatus comprises software processing unit, which respectively access a main bus line 1005, such as an image input unit 1003, an image signal processing unit 1004 compatible with it, and a CPU 1000 serving as a central control unit. The inkjet printing apparatus also comprises hardware processing unit such as an operation unit 1006, recovery control circuit 1007, inkjet head temperature control circuit 1014, head driving control circuit 1015, main scanning carriage driving control circuit 1016, and sub-scanning conveyance control circuit 1017.

The CPU 1000 normally has a ROM 1001 and random access memory (RAM) 1002, and gives an appropriate printing condition in response to input information to drive a printhead 102, thereby printing. The ROM 1001 stores in advance a program for executing a head recovery timing chart. The CPU 1000 gives recovery conditions such as a preliminary discharge condition to, for example, the recovery control circuit 1007, the printhead 102, and a heater as needed. The CPU 1000 performs printing medium conveyance control in addition to the printing control and recovery control, so as to control the conveyance amount of a printing medium in accordance with the printing mode.

A recovery motor 1008 drives the printhead 102 described above, and drives a cleaning blade 1009, cap 1010, and suction pump 1011 which are separated from the printhead 102 while facing it. The head driving control circuit 1015 executes the driving condition of an ink discharge electrothermal converter of the printhead 102 so that the printhead 102 performs normal preliminary discharge or printing ink discharge.

An element substrate having the ink discharge electrothermal converter of the printhead 102 also has a heater, and can control the ink temperature in the printhead to a desired set temperature by heating. A thermistor 1012 is also formed on the element substrate and serves to practically measure the ink temperature inside the printhead. The thermistor 1012 may be externally provided instead of forming it on the element substrate, or may be formed around the printhead 102.

Figure 3C:
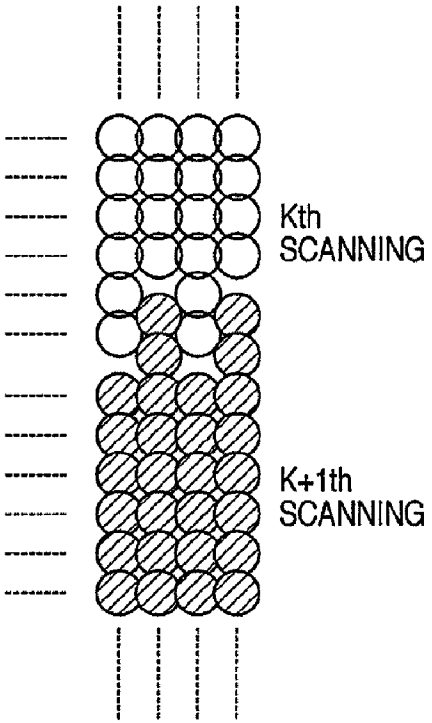
FIGS. 3A, 3B, and 3C are views each illustrating an example of the state of the contact portion between dots printed by the Kth scanning and (K+1)th scanning.

Embodiments of the present invention will be explained next with reference to the accompanying drawings. In the following embodiments, as shown in FIG. 3C, image regions in the contact portion between successive scanning operations on a printing medium are printed such that the position of a dot printed by the preceding scanning differs from that of a dot printed by the succeeding scanning.

First Embodiment

A printhead 102 used in this embodiment has 256 discharge orifices with a density of 600 dots per inch (600 dpi). The width that a printing element array prints per scanning is 256/600 inches≈10.84 mm. In this embodiment, the sizes of ink droplets discharged from the ink discharge orifices 201 shown in FIG. 2 are 5 pl. The discharge frequency and discharge speed required to stably discharge ink droplets in this amount are 30 KHz and about 18 m/sec. The scanning speed of a carriage 106 which mounts the printhead 102 is 25 inches/sec. Under this condition, an image is formed with a printing density of 1200 dpi in the scanning direction.

Figure 11:
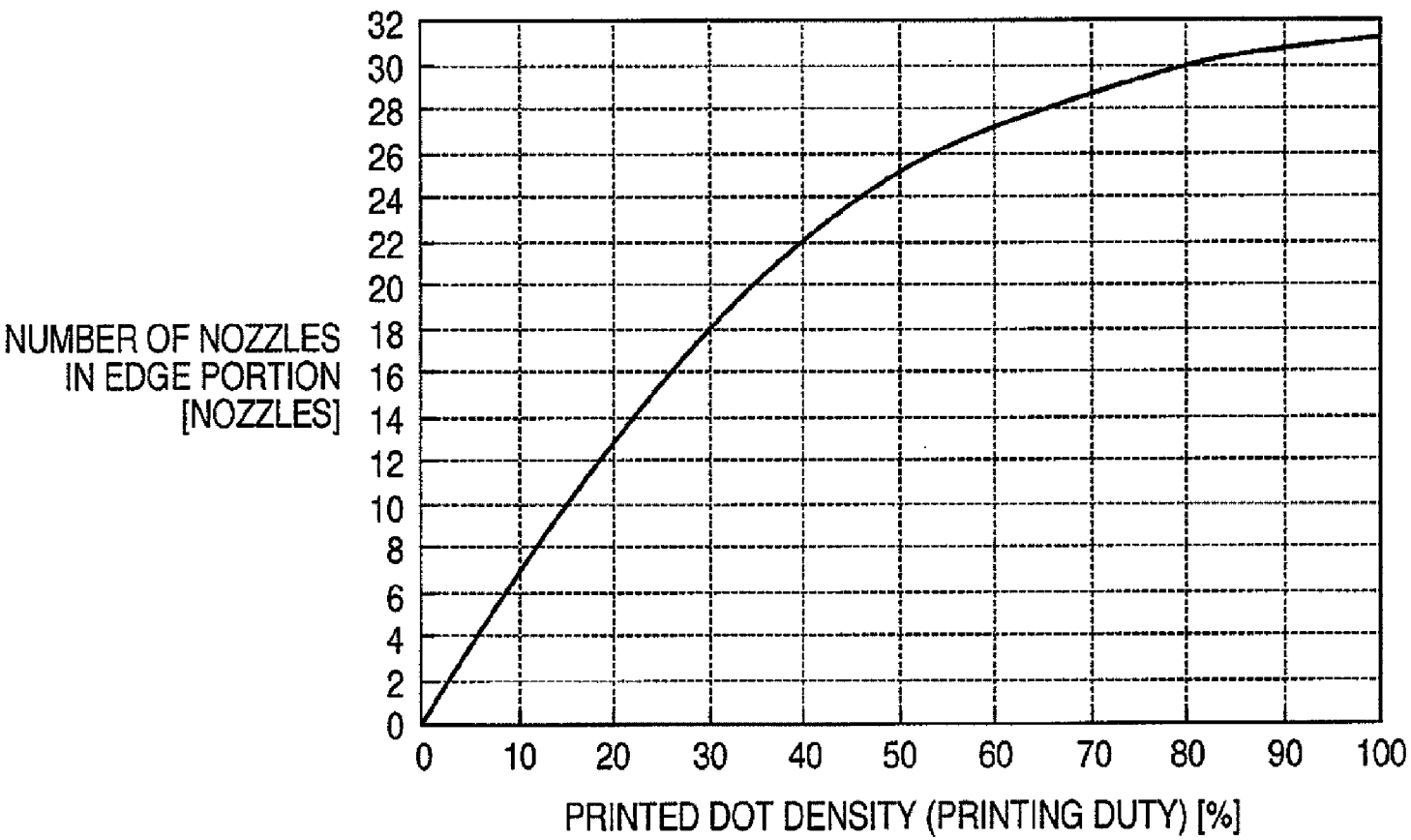
FIG. 11 is a graph showing the relationship between the printing duty and the number of nozzles in the edge portion of the nozzle array where edge deviation occurs.

FIG. 11 is a graph showing the relationship between the density (printing duty) of dots printed by one scanning operation using all of the 256 ink discharge orifices of the printhead 102 according to this embodiment and the number of nozzles in the edge portion of the nozzle array where edge deviation occurs due to the presence of an air current. The number of nozzles in the edge portion of the nozzle array where edge deviation occurs due to the presence of an air current will be simply referred to as the number of nozzles in which edge deviation occurs hereinafter. That the printing duty is 100% means the state in which printing is performed in the scanning direction with a cartridge scanning speed of 25 inches/sec, a discharge frequency of 30 KHz, and a printing density of 1200 dpi by discharging inks from all of the 256 ink discharge orifices. At this time, the number of nozzles in which edge deviation occurs is 31, and therefore the landing position of an ink droplet is shifted in a region in which printing is performed with 31 nozzles.

FIG. 11 reveals that the lower the printing duty, the smaller the number of nozzles in which edge deviation occurs. FIG. 11 also reveals that the higher the printing duty, the lower the rate of increase in the number of nozzles in which edge deviation occurs.

Figure 12:
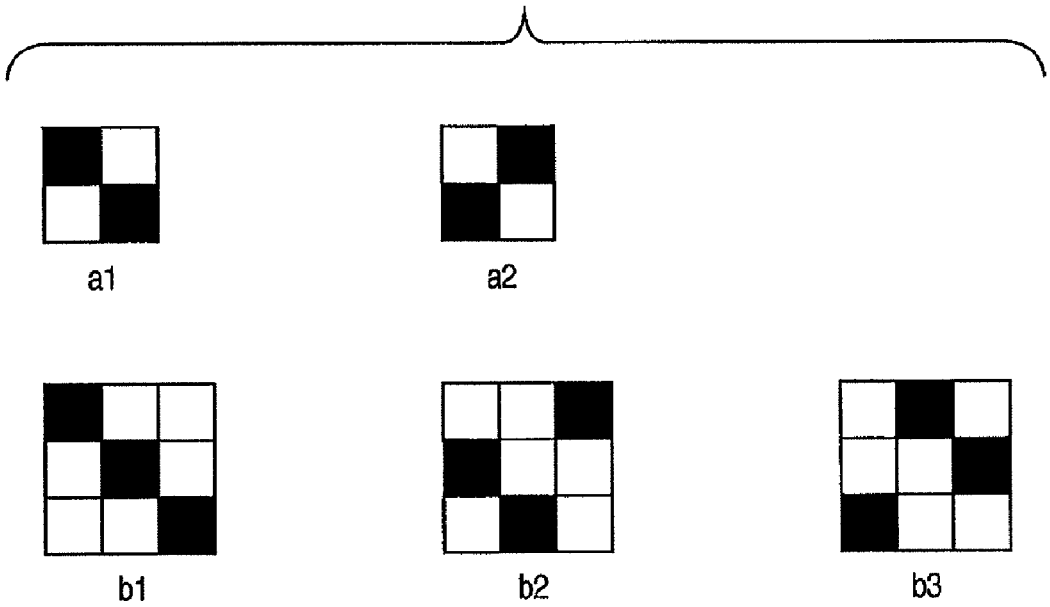
FIG. 12 is an explanatory view showing a mask pattern used in the first embodiment of the present invention.

FIG. 12 shows mask patterns used in this embodiment. a1 and a2 in FIG. 12 show complementary mask patterns each with a mask ratio matching a printing duty of 1/2 with respect to image data with a printing duty of 100%. b1, b2, and b3 in FIG. 12 show complementary mask patterns each with a mask ratio matching a printing duty of 1/3 with respect to image data with a printing duty of 100%.

Figure 13:
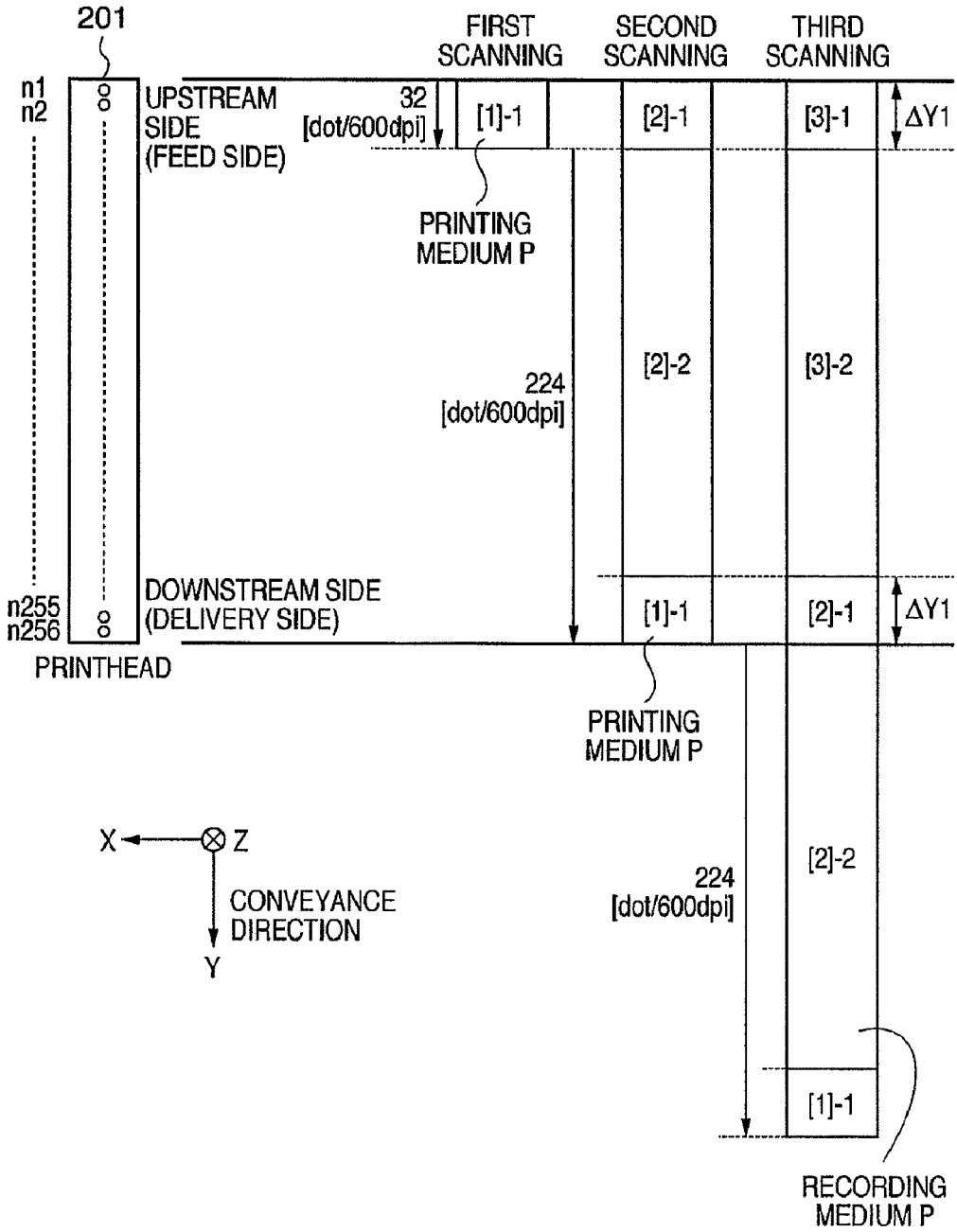
FIG. 13 is a schematic explanatory diagram showing a printing method in a one-pass printing mode according to the first embodiment of the present invention.

FIG. 13 is a diagram for explaining a printing operation in a one-pass printing mode according to this embodiment. The one-pass printing mode according to this embodiment does not mean a printing mode in which images are completed in all printing regions by scanning a printhead once. According to this embodiment, in a region (to be referred to as a normal region hereinafter) through which nozzles in the middle portion of a printhead pass, an image is printed by scanning the printhead once. On the other hand, in a region (to be referred to as an edge region hereinafter) through which nozzles in the two edge portions of a printhead where edge deviation occurs pass, an image is printed by scanning the printhead twice so that nozzles in the two edge portions of the printhead print the same region. The printing operation in the one-pass printing mode according to this embodiment will be explained in detail below.

First, a printing medium P is conveyed in the Y direction different from the scanning direction of the printhead so as to print using 32 nozzles n1 to n32 on the upstream side (feed side) of 256 nozzles in the first scanning shown in FIG. 13.

After completing the conveyance, an image region [1]-1 on the printing medium P is printed using the mask pattern shown in a1 of FIG. 12 and 32 nozzles n1 to n32 on the upstream side (feed side) in the first scanning.

The printing medium P is further conveyed in the Y direction by 224 [dots/600 dpi] so as to print using all of the 256 nozzles. In other words, the printing medium P is further conveyed by a width of 224 [dots/600 dpi], which is narrower than the width of 256 [dots/600 dpi] that the printing element array of the printhead prints.

After completing the conveyance, the image region [1]-1 printed using the mask pattern shown in a1 of FIG. 12 in the first scanning is printed using the mask pattern shown in a2 of FIG. 12 and 32 nozzles n225 to n256 on the downstream side (delivery side) in the second scanning to complete an image.

An image region [2]-1 is printed using the mask pattern shown in a1 of FIG. 12 and 32 nozzles n1 to n32 on the upstream side in the same manner as in the printing of the image region [1]-1 by the first scanning.

An image region [2]-2 is printed using 192 nozzles n33 to n224 in the middle portion without thinning (mask) to complete an image.

The printing medium P is further conveyed in the Y direction by 224 [dots/600 dpi]. After completing the conveyance, the image region [2]-1 printed using the mask pattern shown in a1 of FIG. 12 in the second scanning is printed using the mask pattern shown in a2 of FIG. 12 and 32 nozzles n225 to n256 on the downstream side in the third scanning to complete an image.

An image region [3]-1 is printed using the mask pattern shown in a1 of FIG. 12 and 32 nozzles n1 to n32 on the upstream side in the same manner as in the printing of the image regions [1]-1 and [2]-1 by the first scanning and second scanning, respectively.

An image region [3]-2 is printed using 192 nozzles n33 to n224 in the middle portion without thinning in the same manner as in the printing of the image region [2]-2 by the second scanning to complete an image.

Images are completed by the fourth and subsequent scanning operations while repeating the conveyance of the printing medium P in the Y direction by 224 [dots/600 dpi] and the printing operation in the third scanning.

In the one-pass printing mode, the maximum printing duty is 100%. FIG. 11 reveals that the maximum number of nozzles in which edge deviation occurs is 31. In view of this, this embodiment assumes a region through which 32 nozzles in the edge portion of the printhead pass as an edge region. An image is completed in this edge region by scanning the printhead twice using the two edge portions of the printhead.

In other words, in the one-pass printing mode according to this embodiment, an image region printed using 32 nozzles n1 to n32 on the upstream side of the 256 nozzles matches an image region printed using 32 nozzles n22 to n256 on the downstream side. This makes it possible to reduce deterioration in image due to the presence of an unprinted stripe occurred in the contact portion between successive scanning operations of the printhead.

Figure 14:
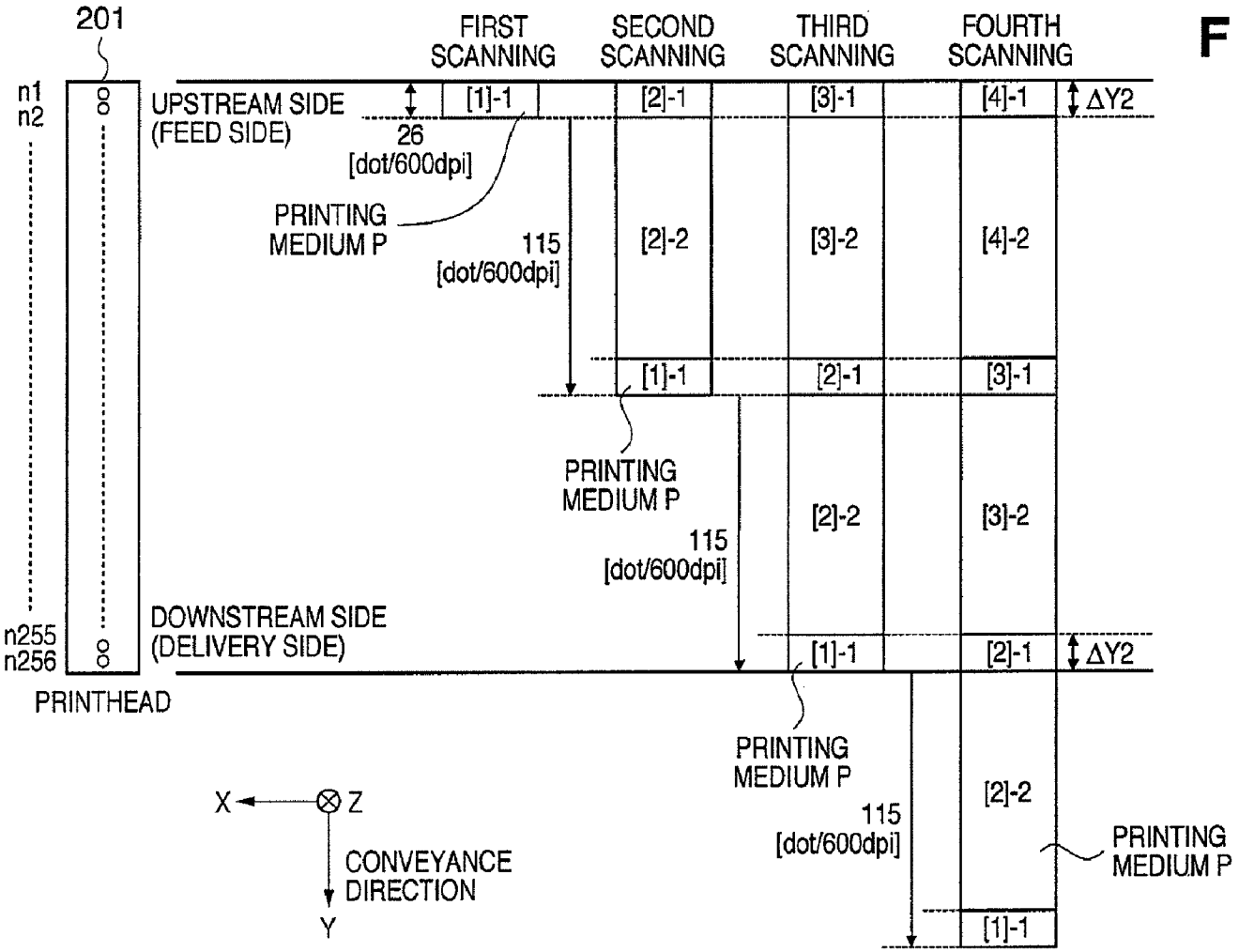
FIG. 14 is a schematic explanatory diagram showing a printing method in a multipass printing mode according to the first embodiment of the present invention.

FIG. 14 is a diagram for explaining a printing operation in a multipass printing mode (two-pass printing mode) according to this embodiment. The two-pass printing mode according to this embodiment does not mean a printing mode in which images corresponding to all printing regions are completed by scanning a printhead twice. According to this embodiment, an image is printed in a normal region by scanning the printhead twice, while an image is printed in an edge region by scanning the printhead three times. The printing operation in the two-pass printing mode according to this embodiment will be explained in detail below.

First, a printing medium P is conveyed in the Y direction so as to print using 26 nozzles n1 to n26 on the upstream side of 256 nozzles in the first scanning shown in FIG. 14.

After completing the conveyance, an image region [1]-1 on the printing medium P is printed using the mask pattern shown in b1 of FIG. 12 and 26 nozzles n1 to n26 on the upstream side in the first scanning.

The printing medium P is further conveyed in the Y direction by 115 [dots/600 dpi] so as to print using 141 nozzles n1 to n141 on the upstream side of the 256 nozzles.

After completing the conveyance, the image region [1]-1 printed using the mask pattern shown in b1 of FIG. 12 in the first scanning is printed using the mask pattern shown in b2 of FIG. 12 and 26 nozzles n116 to n141 in the middle portion in the second scanning.

An image region [2]-1 is printed using the mask pattern shown in b1 of FIG. 12 and 26 nozzles n1 to n26 on the upstream side in the same manner as in the printing of the image region [1]-1 by the first scanning.

An image region [2]-2 is printed using the mask pattern shown in a1 of FIG. 12 and 89 nozzles n27 to n115 in the middle portion.

The printing medium P is further conveyed in the Y direction by 115 [dots/600 dpi] so as to print using all of the 256 nozzles.

After completing the conveyance, the image region [1]-1 which is printed using the mask pattern shown in b1 of FIG. 12 in the first scanning and printed using the mask pattern shown in b2 of FIG. 12 in the second scanning is printed by the third scanning. More specifically, the image region [1]-1 is printed using the mask pattern shown in b3 of FIG. 12 and 26 nozzles n231 to n256 on the downstream side to complete an image.

The image region [2]-2 printed using the mask pattern shown in a1 of FIG. 12 in the second scanning is printed using the mask pattern shown in a2 of FIG. 12 and 89 nozzles n142 to n230 in the middle portion to complete an image.

The image region [2]-1 is printed in the same manner as in the printing of the image region [1]-1 by the second scanning. More specifically, the image region [2]-1 printed using the mask pattern shown in b1 of FIG. 12 in the second scanning is printed using the mask pattern shown in b2 of FIG. 12 and 26 nozzles n116 to n141 in the middle portion.

An image region [3]-1 is printed using the mask pattern shown in b1 of FIG. 12 and 26 nozzles n1 to n26 on the upstream side in the same manner as in the printing of the image regions [1]-1 and [2]-1 by the first scanning and second scanning, respectively.

An image region [3]-2 is printed using the mask pattern shown in a1 of FIG. 12 and 89 nozzles n27 to n115 in the middle portion in the same manner as in the printing of the image region [2]-2 by the second scanning.

The printing medium P is further conveyed in the Y direction by 115 [dots/600 dpi].

After completing the conveyance, the image region [2]-1 which is printed using the mask pattern shown in b1 of FIG. 12 in the second scanning and printed using the mask pattern shown in b2 of FIG. 12 in the third scanning is printed by the fourth scanning. More specifically, the image region [2]-1 is printed using the mask pattern shown in b3 of FIG. 12 and 26 nozzles n231 to n256 on the downstream side to complete an image.

The image region [3]-2 printed using the mask pattern shown in a1 of FIG. 12 in the third scanning is printed using the mask pattern shown in a2 of FIG. 12 and 89 nozzles n142 to n230 in the middle portion to complete an image.

The image region [3]-1 is printed in the same manner as in the printing of the image regions [1]-1 and [2]-1 by the second scanning and third scanning, respectively. More specifically, the image region [3]-1 printed using the mask pattern shown in b1 of FIG. 12 in the previous third scanning is printed using the mask pattern shown in b2 of FIG. 12 and 26 nozzles n116 to n141 in the middle portion.

An image region [4]-1 is printed in the same manner as in the printing of the image regions [1]-1, [2]-1, and [3]-1 by the first scanning, second scanning, and third scanning, respectively. More specifically, an image region [4]-1 is printed using the mask pattern shown in b1 of FIG. 12 and 26 nozzles n1 to n26 on the upstream side.

An image region [4]-2 is printed using the mask pattern shown in a1 of FIG. 12 and 89 nozzles n27 to n115 in the middle portion in the same manner as in the printing of the image regions [2]-2 and [3]-2 by the second scanning and third scanning, respectively. Images are completed by the fifth and subsequent scanning operations while repeating the conveyance of the printing medium P in the Y direction by 115 [dots/600 dpi] and the printing operation in the fourth scanning.

In the two-pass printing mode, the maximum printing duty is 50%. FIG. 11 reveals that the maximum number of nozzles in the edge portion of the nozzle array where edge deviation occurs due to the presence of an air current is 25. In view of this, this embodiment assumes a region through which 26 nozzles in the edge portion of the printhead pass as an edge region. An image is completed in this edge region by three scanning operations of the printhead, including printing scanning operations using the two edge portions of the printhead.

In other words, in the two-pass printing mode according to this embodiment, an image region printed using 26 nozzles n1 to n26 on the upstream side of the 256 nozzles matches an image region printed using 26 nozzles n231 to n256 on the downstream side. This makes it possible to reduce deterioration in image due to the presence of an unprinted stripe occurred in the contact portion between successive scanning operations of the printhead.

As described above, to reduce deterioration in image due to the presence of an unprinted stripe occurred in the contract portion between successive scanning operations of the printhead, the following condition is necessary in the one-pass printing mode explained with reference to FIG. 13. That is, a region through which an image is printed using the two edge portions of the printhead, that is, an edge region has a width ΔY1 corresponding to 32 nozzles in the conveyance direction.

In the multipass printing mode (two-pass printing mode) explained with reference to FIG. 14, an edge region has a width ΔY2 corresponding to 26 nozzles in the conveyance direction, which is narrower than a width ΔY1 corresponding to 32 nozzles. Printing under this condition allows not only a reduction of deterioration in image due to the presence of an unprinted stripe occurred in the contact portion between successive scanning operations of the printhead but also high-speed printing.

Figure 3B:
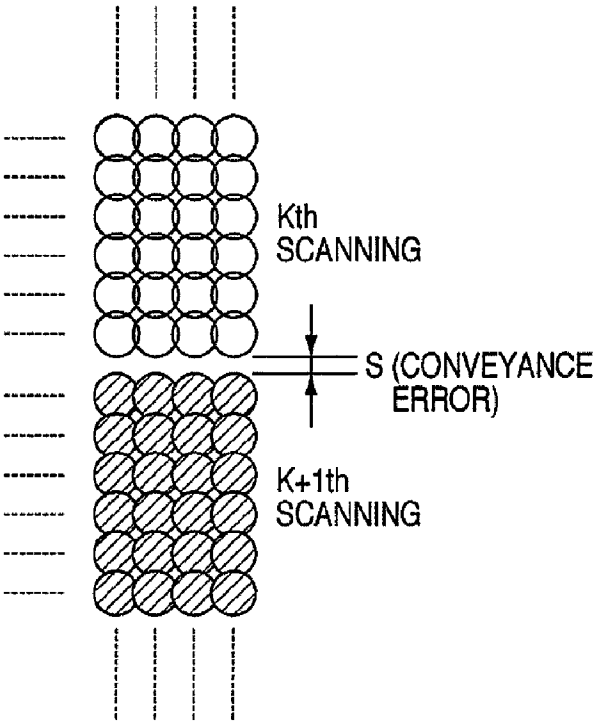
Figure 3A:
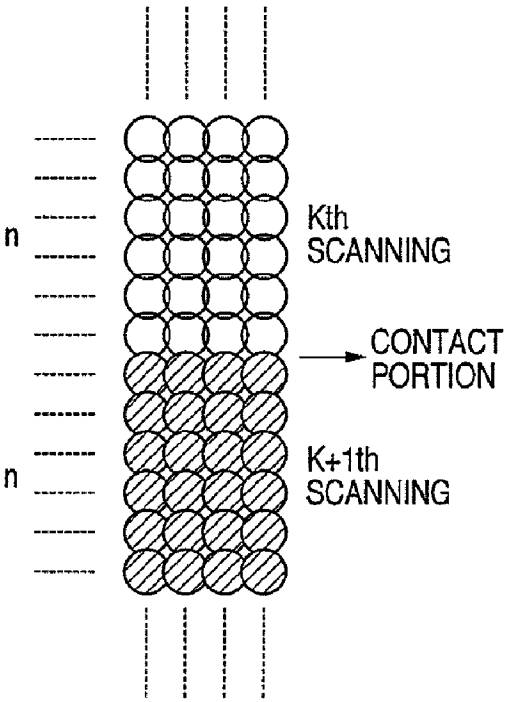
Figure 4C:
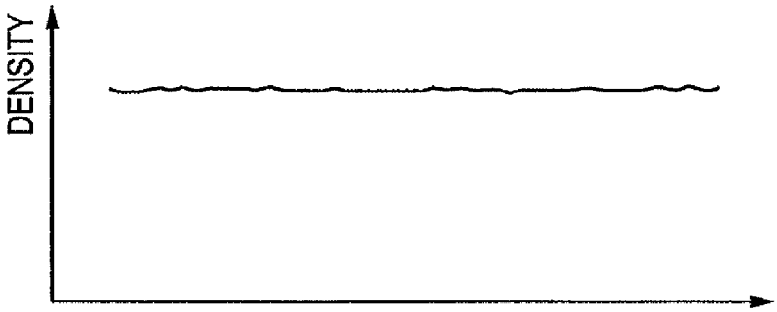
FIGS. 4A, 4B, and 4C are diagrams and a graph showing the state in which an inkjet printing apparatus prints an ideal image.
Figure 4B:
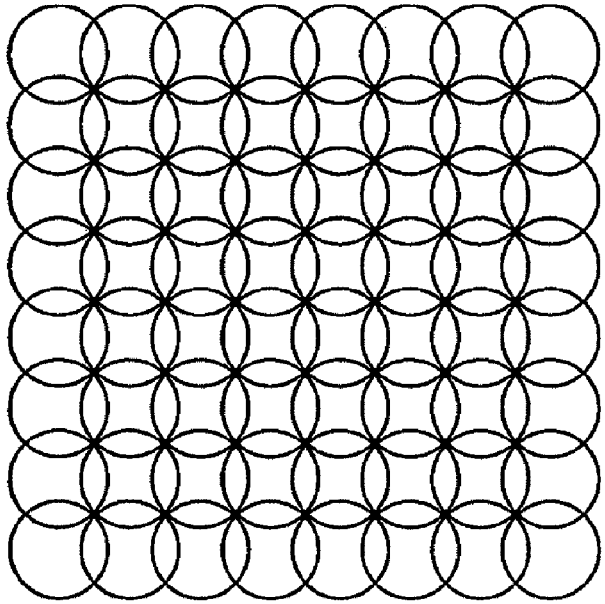
Figure 4A:
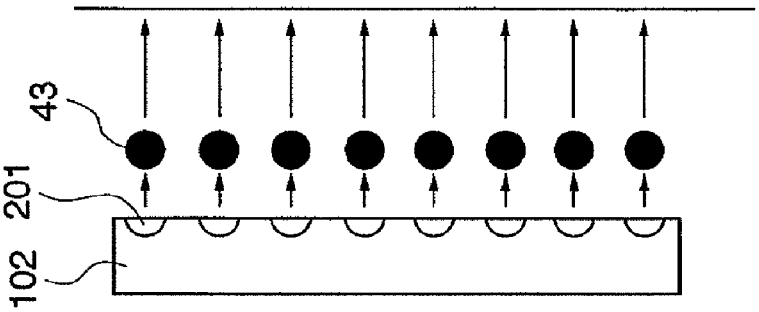
Figure 5C:
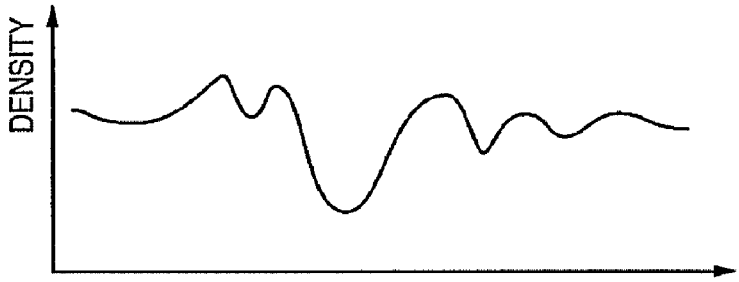
FIGS. 5A, 5B, and 5C are diagrams and a graph showing the state in which an inkjet printing apparatus prints an image with density unevenness.
Figure 5B:
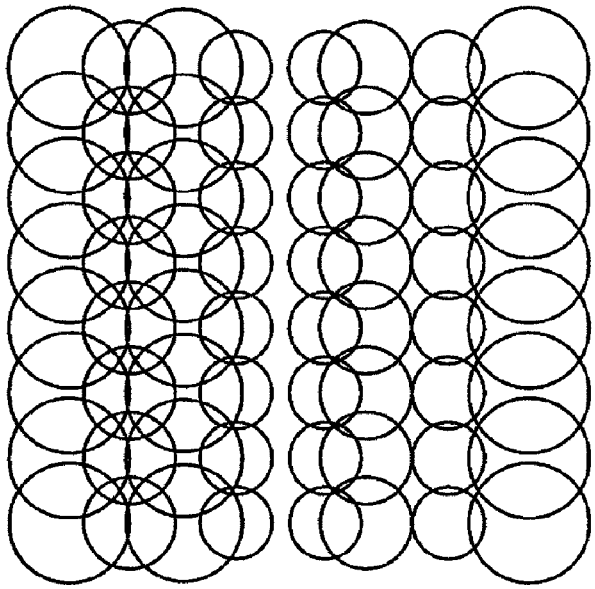
Figure 5A:
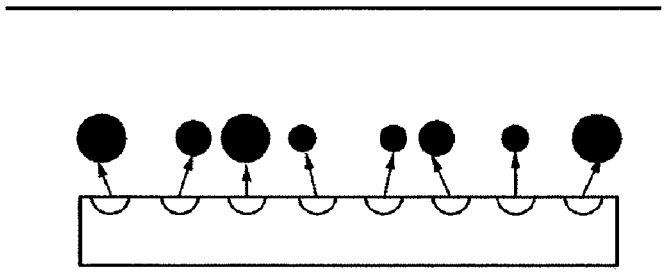
Figure 6A:
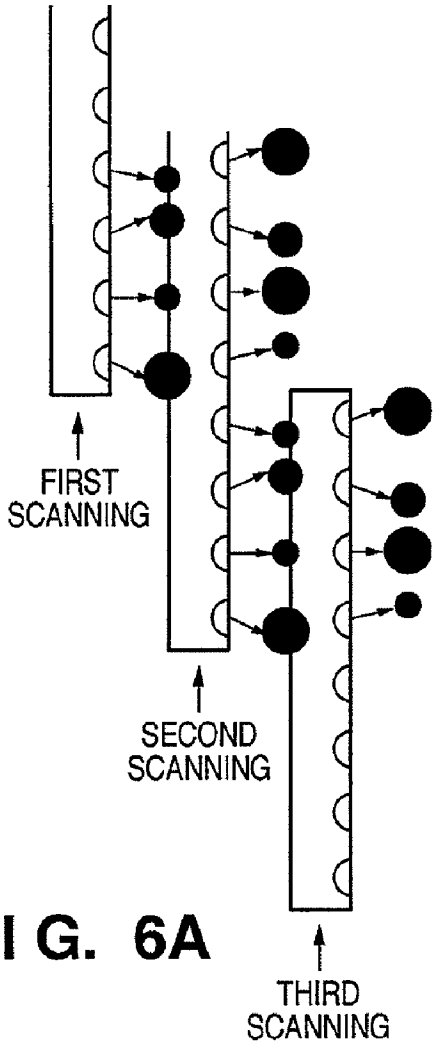
FIGS. 6A, 6B, and 6C are diagrams and a graph for explaining a multipass printing mode to reduce density unevenness.
Figure 6B:
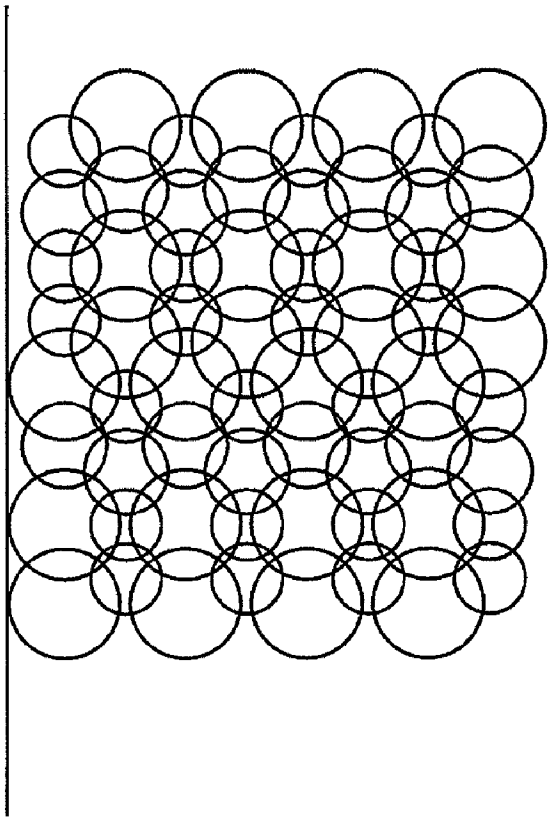
Figure 6C:
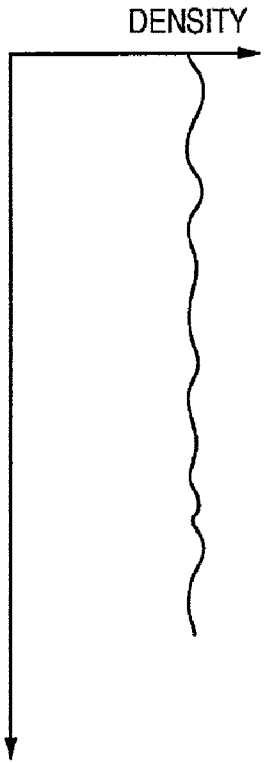
Figure 7A:
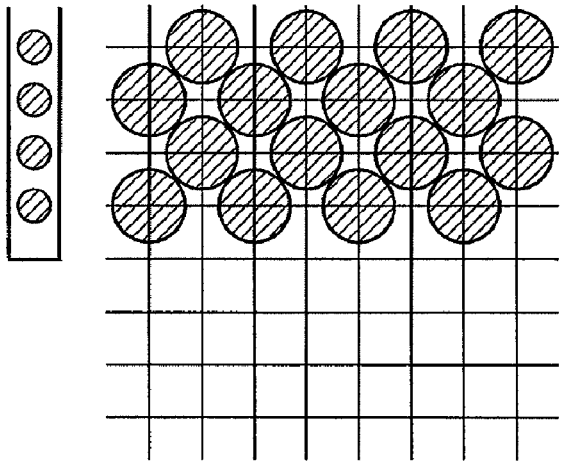
FIGS. 7A, 7B, and 7C are views for explaining another multipass printing mode to reduce density unevenness.
Figure 7B:
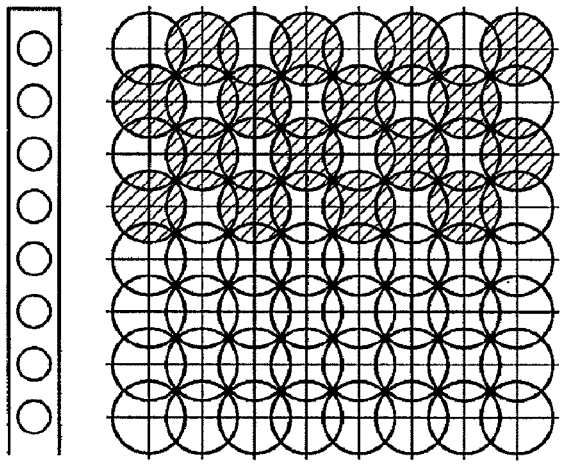
Figure 7C:
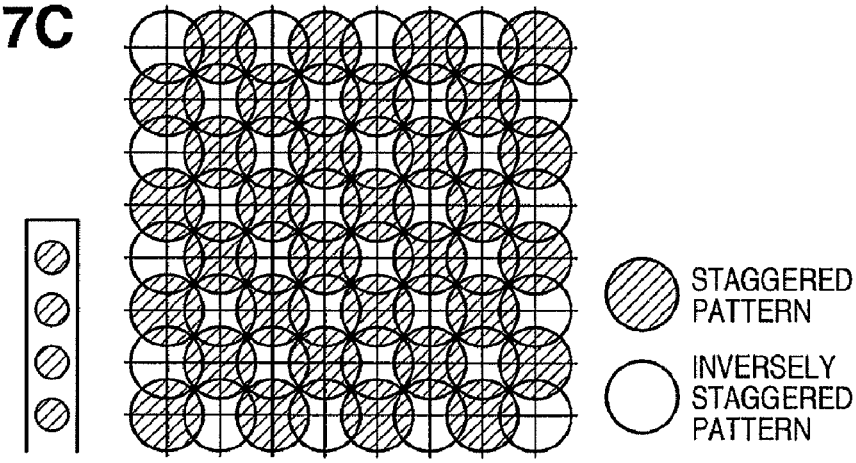
Figure 8:
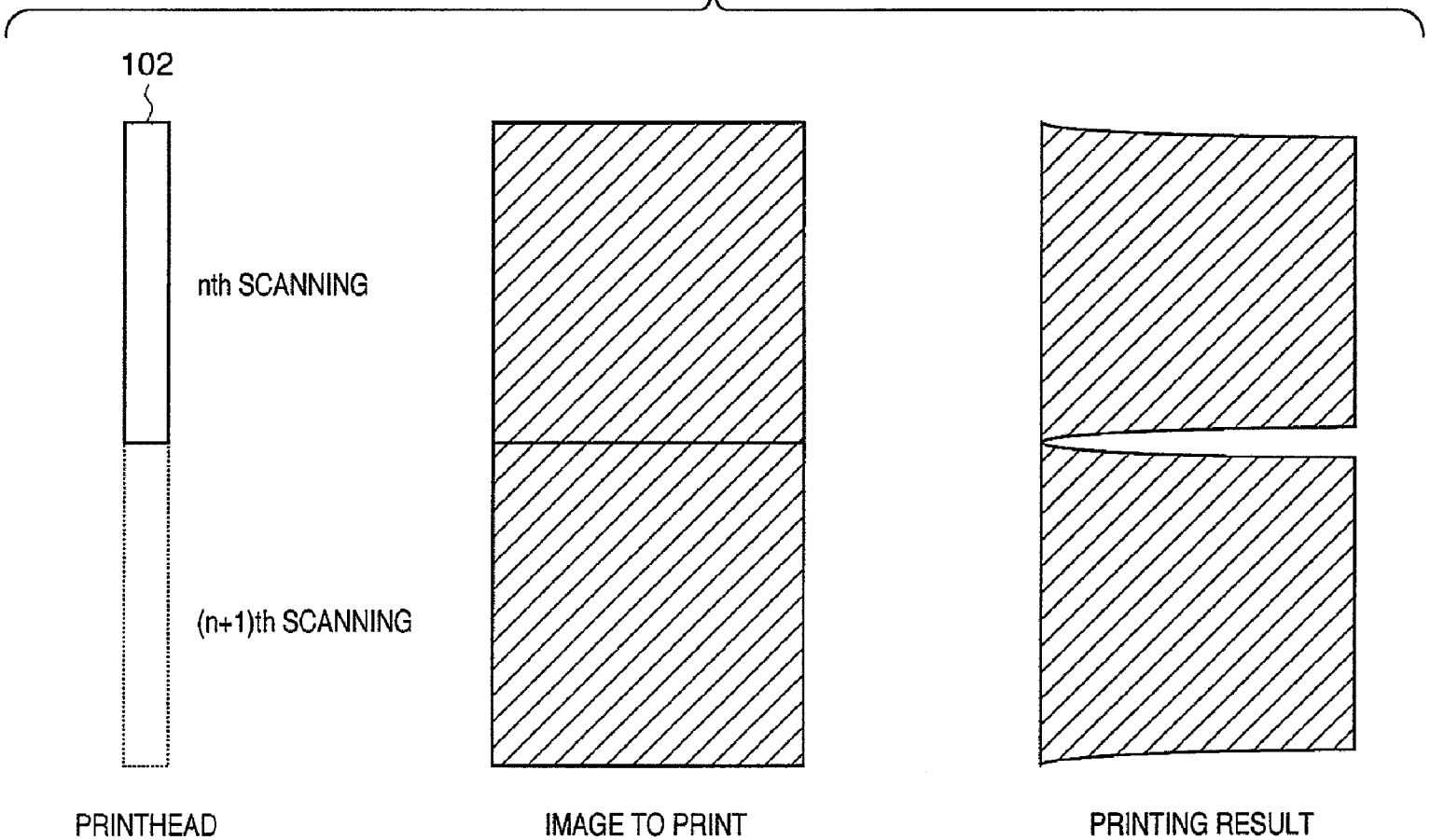
FIG. 8 is a view for explaining a printing result suffering edge deviation as the conventional problem.
Figure 9:
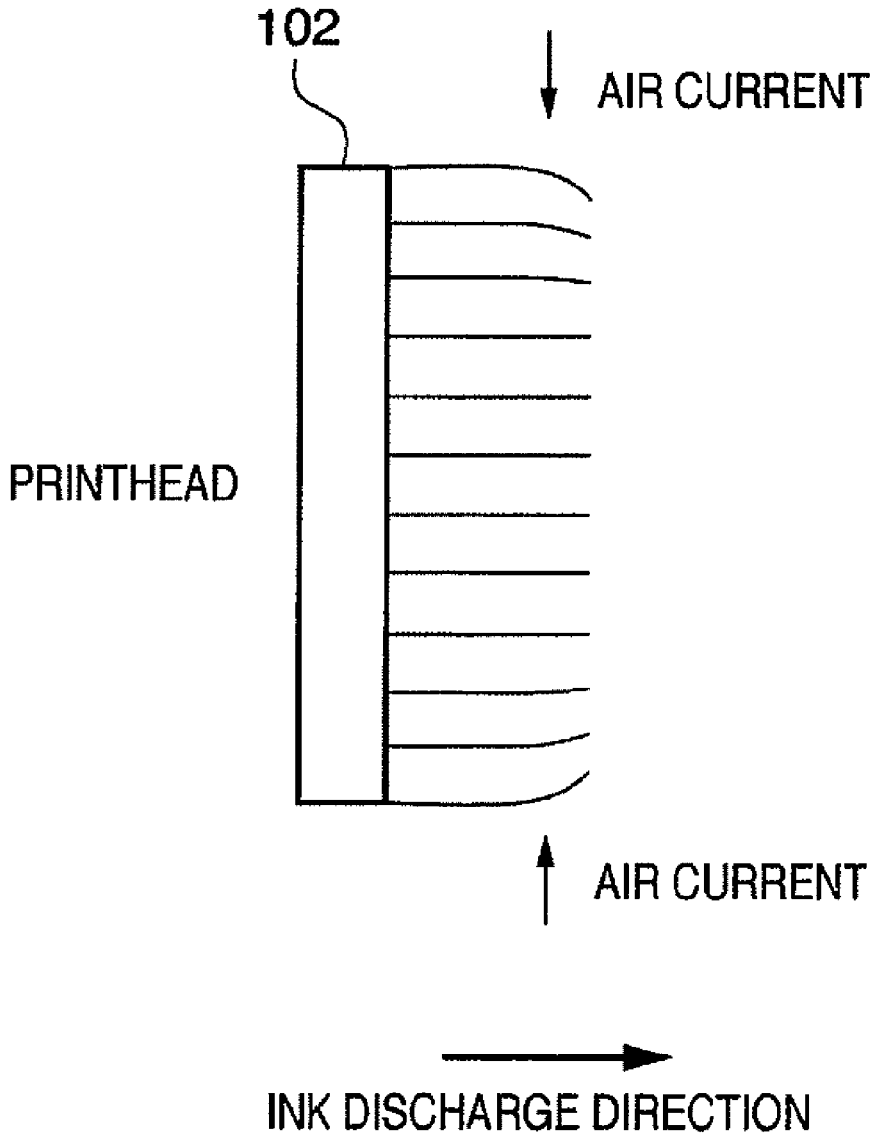
FIG. 9 is a view for explaining the cause of edge deviation as the conventional problem.

In this embodiment, the number of times of printing scanning (2 in the printing operation shown in FIG. 13, and 3 in the printing operation shown in FIG. 14) in an edge region is larger than that (1 in the printing operation shown in FIG. 13, and 2 in the printing operation shown in FIG. 14) in a normal region. The printing density of the edge region per scanning is thus lower than that of the normal region. Printing under this condition allows further decreasing the number of nozzles in the edge portion of the nozzle array where edge deviation occurs due to the presence of an air current, thus attaining printing with both a higher image quality and higher speed.

Figure 18:
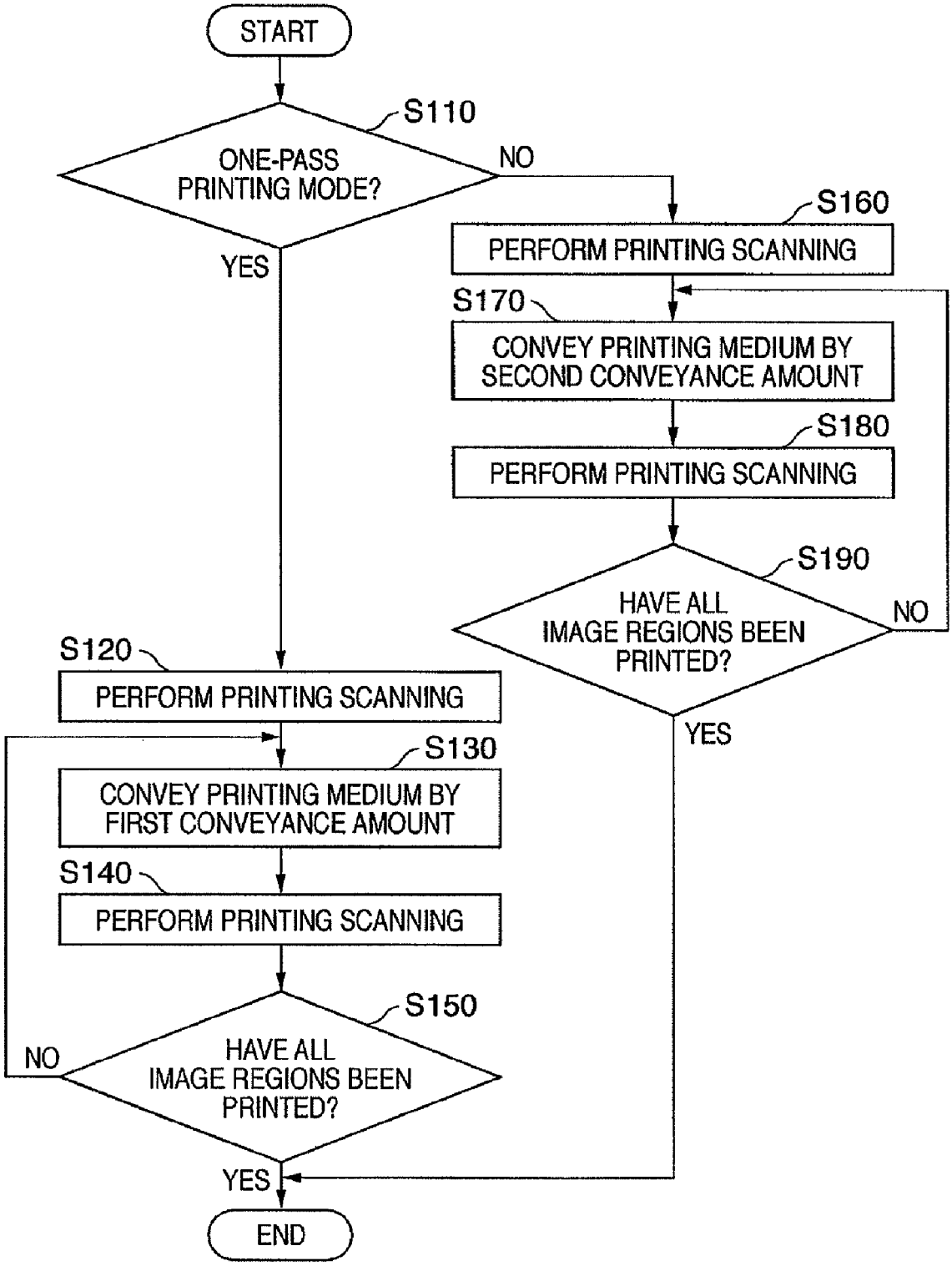
FIG. 18 is a flowchart illustrating a printing method according to the present invention.

FIG. 18 is a flowchart illustrating a printing method according to this embodiment.

As the printing operation starts, in step S110 the user selects the printing mode via the operation unit 1006 or an external host device. If the user selects the one-pass printing mode, printing scanning is performed once in step S120. In step S130, a printing medium is then conveyed by a first conveyance amount so that nozzles in the edge portions of the nozzle array on the upstream and downstream sides print the same region (edge region). In step S140, printing scanning is performed once. If all image regions have been printed, the printing operation ends; otherwise, the process returns to step S130 to continue the printing operation (step S150). If the user does not select the one-pass printing mode in step S110, printing scanning is performed once in step S160. In step S170, a printing medium is then conveyed by a second conveyance amount so that nozzles in the edge portions of the nozzle array on the upstream and downstream sides print the same region (edge region). Note that the second conveyance amount is smaller than the first conveyance amount. In step S180, printing scanning is performed once. If all image regions have been printed, the printing operation ends; otherwise, the process returns to step S170 to continue the printing operation (step S190).

Second Embodiment

The first embodiment has exemplified an arrangement which can execute the one-pass printing mode and multipass printing mode. The second embodiment will be explained by taking an arrangement which can execute a plurality of multipass printing modes as an example. This embodiment will exemplify an arrangement which can execute the two-pass printing mode (see FIG. 14) according to the first embodiment, and a four-pass printing mode to be explained hereinafter.

A printhead used in this embodiment is the same as the printhead 102 used in the first embodiment.

Figure 15:
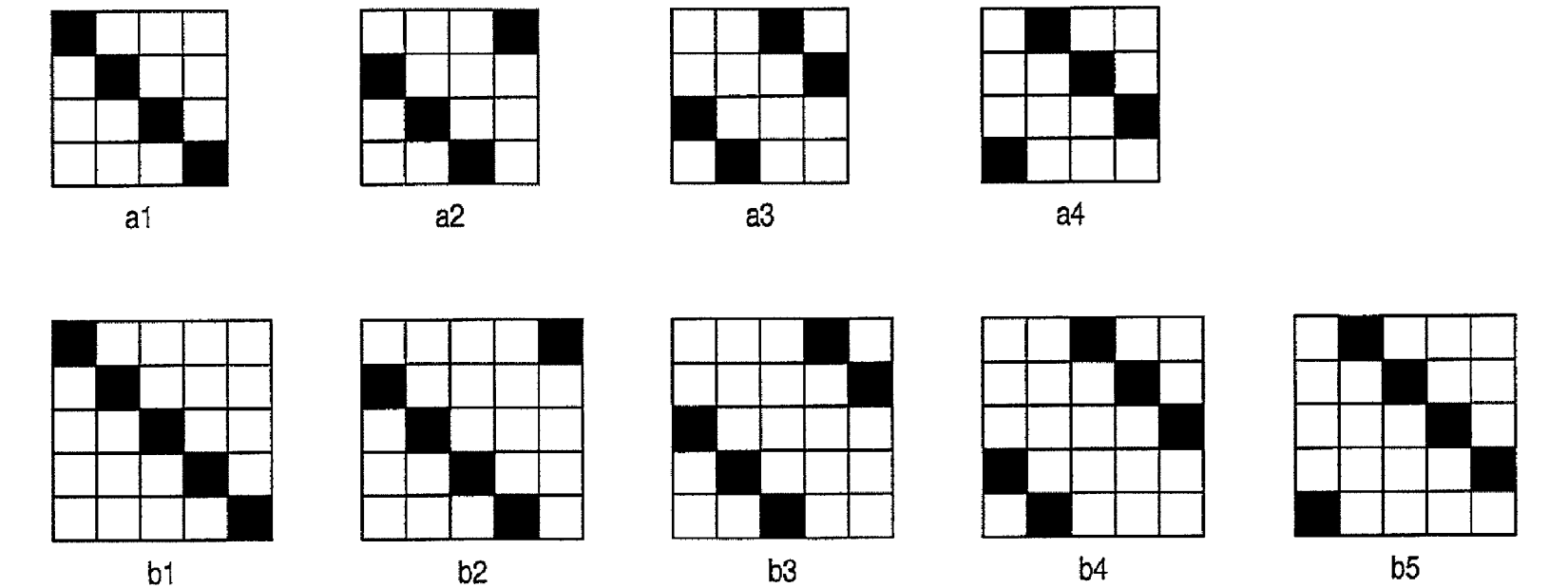
FIG. 15 is an explanatory view showing a mask pattern used in the second embodiment of the present invention.

FIG. 15 shows mask patterns used in this embodiment. a1, a2, a3, and a4 in FIG. 15 show complementary mask patterns each with a mask ratio matching a printing duty of 1/4 with respect to image data with a printing duty of 100%. b1, b2, b3, b4, and b5 in FIG. 15 show complementary mask patterns each with a mask ratio matching a printing duty of 1/5 with respect to image data with a printing duty of 100%.

Figure 16:
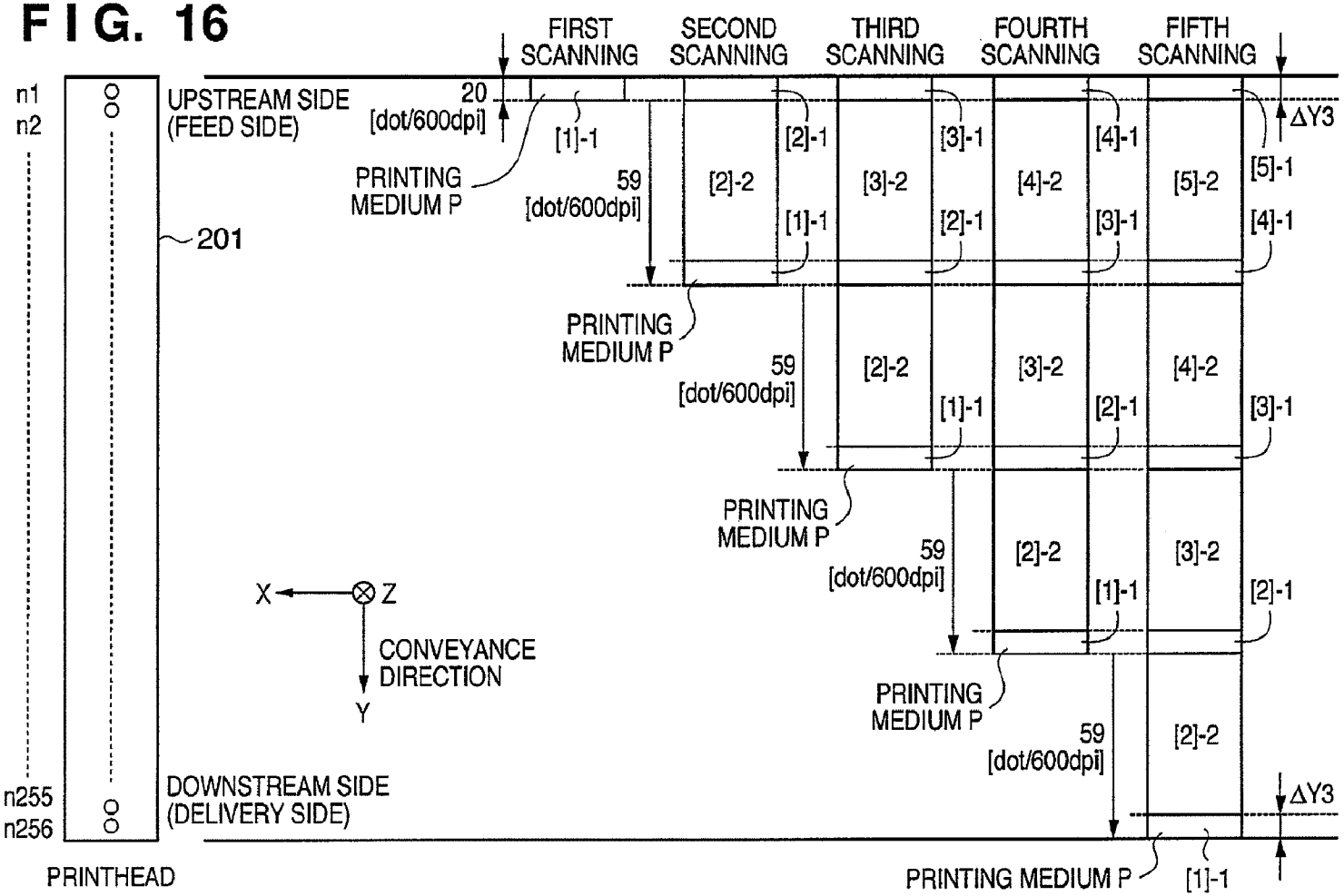
FIG. 16 is a schematic explanatory diagram showing a printing method in the multipass printing mode according to the second embodiment of the present invention.

FIG. 16 is a diagram for explaining a printing operation in a four-pass printing mode according to this embodiment. The four-pass printing mode according to this embodiment does not mean a printing mode in which images are completed in all printing regions by scanning a printhead four times, either. In the four-pass printing mode according to this embodiment, an image is printed in a normal region by scanning the printhead four times, while an image is printed in an edge region by scanning the printhead five times. The printing operation in the four-pass printing mode according to this embodiment will be explained in detail below.

First, a printing medium P is conveyed in the Y direction so as to print using 20 nozzles n1 to n20 on the upstream side of 256 nozzles in the first scanning shown in FIG. 16.

After completing the conveyance, an image region [1]-1 on the printing medium P is printed using the mask pattern shown in b1 of FIG. 15 and 20 nozzles n1 to n20 on the upstream side in the first scanning.

The printing medium P is further conveyed in the Y direction by 59 [dots/600 dpi] so as to print using 79 nozzles n1 to n79 on the upstream side of the 256 nozzles.

After completing the conveyance, the image region [1]-1 printed using the mask pattern shown in b1 of FIG. 15 in the first scanning is printed using the mask pattern shown in b2 of FIG. 15 and 20 nozzles n60 to n79 in the middle portion in the second scanning.

An image region [2]-1 is printed using the mask pattern shown in b1 of FIG. 15 and 20 nozzles n1 to n20 on the upstream side in the same manner as in the printing of the image region [1]-1 by the first scanning.

An image region [2]-2 is printed using the mask pattern shown in a1 of FIG. 15 and 39 nozzles n21 to n59 in the middle portion.

The printing medium P is further conveyed in the Y direction by 59 [dots/600 dpi] so as to print using 138 nozzles n1 to n138 on the upstream side of the 256 nozzles.

After completing the conveyance, the image region [1]-1 which is printed using the mask pattern shown in b1 of FIG. 15 in the first scanning and printed using the mask pattern shown in b2 of FIG. 15 in the second scanning is printed by the third scanning. More specifically, the image region [1]-1 is printed using the mask pattern shown in b3 of FIG. 15 and 20 nozzles n119 to n138 in the middle portion.

The image region [2]-1 is printed using the mask pattern shown in b2 of FIG. 15 and 20 nozzles n60 to n79 in the middle portion in the same manner as in the printing of the image region [1]-1 by the second scanning.

The image region [2]-2 is printed using the mask pattern shown in a2 of FIG. 15 and 39 nozzles n80 to n118 in the middle portion.

An image region [3]-1 is printed using the mask pattern shown in b1 of FIG. 15 and 20 nozzles n1 to n20 on the upstream side in the same manner as in the printing of the image regions [1]-1 and [2]-1 by the first scanning and second scanning, respectively.

An image region [3]-2 is printed using the mask pattern shown in a1 of FIG. 15 and 39 nozzles n21 to n59 in the middle portion in the same manner as in the printing of the image region [2]-2 by the second scanning.

The printing medium P is further conveyed in the Y direction by 59 [dots/600 dpi].

After completing the conveyance, the image region [1]-1 which is printed using the mask pattern shown in b1 of FIG. 15 in the first scanning, printed using the mask pattern shown in b2 of FIG. 15 in the second scanning, and printed using the mask pattern shown in b3 of FIG. 15 in the third scanning is printed by the fourth scanning. More specifically, the image region [1]-1 is printed using the mask pattern shown in b4 of FIG. 15 and 20 nozzles n178 to n197 in the middle portion.

The image region [2]-1 which is printed using the mask pattern shown in b1 of FIG. 15 in the second scanning and printed using the mask pattern shown in b2 of FIG. 15 in the third scanning is printed in the same manner as in the printing of the image region [1]-1 by the third scanning. More specifically, the image region [2]-1 is printed using the mask pattern shown in b3 of FIG. 15 and 20 nozzles n119 to n138 in the middle portion.

The image region [2]-2 which is printed using the mask pattern shown in a1 of FIG. 15 in the second scanning and printed using the mask pattern shown in a2 of FIG. 15 in the third scanning is printed in the following way. More specifically, the image region [2]-2 is printed using the mask pattern shown in a3 of FIG. 15 and 39 nozzles n139 to n177 in the middle portion.

The image region [3]-1 printed using the mask pattern shown in b1 of FIG. 15 in the third scanning is printed in the same manner as in the printing of the image regions [1]-1 and [2]-1 by the second scanning and third scanning, respectively. More specifically, the image region [3]-1 is printed using the mask pattern shown in b2 of FIG. 15 and 20 nozzles n60 to n79 in the middle portion.

The image region [3]-2 printed using the mask pattern shown in a1 of FIG. 15 in the third scanning is printed in the same manner as in the printing of the image region [2]-2 by the third scanning. More specifically, the image region [3]-2 is printed using the mask pattern shown in a2 of FIG. 15 and 39 nozzles n80 to n118 in the middle portion.

An image region [4]-1 is printed in the same manner as in the printing of the image regions [1]-1, [2]-1, and [3]-1 by the first scanning, second scanning, and third scanning, respectively. More specifically, an image region [4]-1 is printed using the mask pattern shown in b1 of FIG. 15 and 20 nozzles n1 to n20 on the upstream side.

An image region [4]-2 is printed using the mask pattern shown in a1 of FIG. 15 and 39 nozzles n21 to n59 in the middle portion in the same manner as in the printing of the image regions [2]-2 and [3]-2 by the second scanning and third scanning, respectively.

The printing medium P is further conveyed in the Y direction by 59 [dots/600 dpi].

After completing the conveyance, the image region [1]-1 is printed using the mask pattern shown in b5 of FIG. 15 and 20 nozzles n237 to n256 in the fifth scanning to complete an image. The image region [1]-1 is an image region which is printed using the mask pattern shown in b1 of FIG. 15 in the first scanning, printed using the mask pattern shown in b2 of FIG. 15 in the second scanning, printed using the mask pattern shown in b3 of FIG. 15 in the third scanning, and printed using the mask pattern shown in b4 of FIG. 15 in the fourth scanning.

The image region [2]-1 is printed using the mask pattern shown in b4 of FIG. 15 and 20 nozzles n178 to n197 in the middle portion in the same manner as in the printing of the image region [1]-1 by the fourth scanning. The image region [2]-1 is an image region which is printed using the mask pattern shown in b1 of FIG. 15 in the second scanning, printed using the mask pattern shown in b2 of FIG. 15 in the third scanning, and printed using the mask pattern shown in b3 of FIG. 15 in the fourth scanning.

The image region [2]-2 is printed using the mask pattern shown in a4 of FIG. 15 and 39 nozzles n198 to n236 in the middle portion. The image region [2]-2 is an image region which is printed using the mask pattern shown in a1 of FIG. 15 in the second scanning, printed using the mask pattern shown in a2 of FIG. 15 in the third scanning, and printed using the mask pattern shown in a3 of FIG. 15 in the fourth scanning.

The image region [3]-1 printed using the mask pattern shown in b2 of FIG. 15 in the fourth scanning is printed in the same manner as in the printing of the image regions [1]-1 and [2]-1 by the third scanning and fourth scanning, respectively. More specifically, the image region [3]-1 is printed using the mask pattern shown in b3 of FIG. 15 and 20 nozzles n119 to n138 in the middle portion.

The image region [3]-2 which is printed using the mask pattern shown in a1 of FIG. 15 in the third scanning and printed using the mask pattern shown in a2 of FIG. 15 in the fourth scanning is printed in the same manner as in the printing of the image region [2]-2 by the fourth scanning. More specifically, the image region [3]-2 is printed using the mask pattern shown in a3 of FIG. 15 and 39 nozzles n139 to n177 in the middle portion.

The image region [4]-1 printed using the mask pattern shown in b1 of FIG. 15 in the fourth scanning is printed in the same manner as in the printing of the image regions [1]-1, [2]-1, and [3]-1 by the second scanning, third scanning, and fourth scanning, respectively. More specifically, the image region [4]-1 is printed using the mask pattern shown in b2 of FIG. 15 and 20 nozzles n60 to n79 in the middle portion.

The image region [4]-2 printed using the mask pattern shown in a1 of FIG. 15 in the fourth scanning is printed in the same manner as in the printing of the image regions [2]-2 and [3]-2 by the third scanning and second scanning, respectively. More specifically, the image region [4]-2 is printed using the mask pattern shown in a2 of FIG. 15 and 39 nozzles n80 to n118 in the middle portion.

An image region [5]-1 is printed in the same manner as in the printing of the image regions [1]-1, [2]-1, [3]-1, and [4]-1 by the first scanning, second scanning, third scanning, and fourth scanning, respectively. More specifically, an image region [5]-1 is printed using the mask pattern shown in b1 of FIG. 15 and 20 nozzles n1 to n20 on the upstream side.

An image region [5]-2 is printed using the mask pattern shown in a1 of FIG. 15 and 39 nozzles n21 to n59 in the middle portion in the same manner as in the printing of the image regions [2]-2 and [3]-2 by the second scanning and third scanning, respectively.

Images are completed by the sixth and subsequent scanning operations while repeating the conveyance of the printing medium P in the Y direction by 59 [dots/600 dpi] and the printing operation in the fifth scanning.

In the four-pass printing mode according to this embodiment, the maximum printing duty per scanning is 25%. FIG. 11 reveals that the maximum number of nozzles in which edge deviation occurs is 16. In view of this, this embodiment assumes a region through which 20 nozzles in the edge portion of the printhead pass as an edge region. An image is completed in this edge region by five scanning operations of the printhead, including printing scanning operations using the two edge portions of the printhead.

In other words, in the four-pass printing mode according to this embodiment, an image region printed using 20 nozzles n1 to n20 on the upstream side of the 256 nozzles matches an image region printed using 20 nozzles n237 to n256 on the downstream side. This makes it possible to reduce deterioration in image due to the presence of an unprinted stripe occurred in the contact portion between successive scanning operations of the printhead.

As described above, to reduce deterioration in image due to the presence of an unprinted stripe occurred in the contract portion between successive scanning operations of the printhead, it is necessary in the two-pass printing mode explained with reference to FIG. 14 that an edge region has a width ΔY2 corresponding to 26 nozzles in the conveyance direction. In the four-pass printing mode according to this embodiment explained with reference to FIG. 16, an edge region has a width ΔY3 corresponding to 20 nozzles in the conveyance direction, which is narrower than a width ΔY2 corresponding to 26 nozzles. Printing under this condition allows not only a reduction of deterioration in image due to the presence of an unprinted stripe occurred in the contact portion between successive scanning operations of the printhead but also high-speed printing.

In this embodiment, the number of times of printing scanning of an image region printed by nozzles in the edge portions of the nozzle array on the upstream and downstream sides is 5, which is larger than the number of times of printing scanning of other image regions of 4. The printing density of the edge region per scanning is thus lower than that of the normal region. Printing under this condition allows to further decrease the number of nozzles in which edge deviation occurs, thus attaining printing with both a higher image quality and higher speed.

Other Embodiments

Although mask patterns with the same mask ratio are used for each scanning in an image region printed by nozzles in the edge portions of the nozzle array on the upstream and downstream sides in the first and second embodiments, the present invention is not particularly limited to this.

Figure 17:
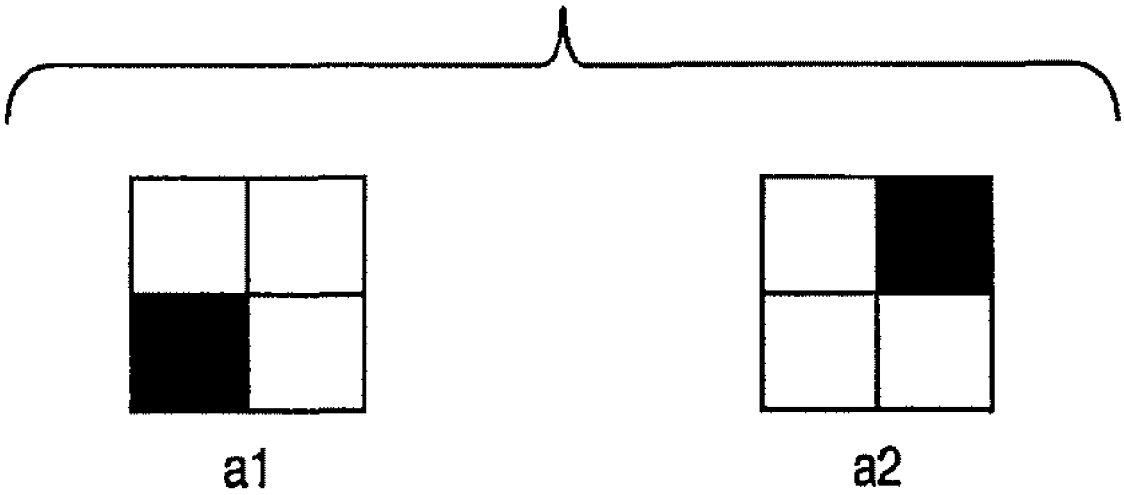
FIG. 17 is an explanatory view showing a mask pattern used in other embodiments of the present invention.

FIG. 17 shows other mask patterns used in other embodiments of the present invention. The mask patterns shown in a1 and a2 of FIG. 17 are obtained by further thinning out the mask pattern shown in a2 of FIG. 12 to 1/2, and have a mask ratio matching a printing duty of 1/4. The mask pattern shown in a1 of FIG. 12 has a printing duty of 1/2 with respect to image data with a printing duty of 100%. The mask patterns shown in a1 and a2 of FIG. 17 have a printing duty of 1/4 with respect to image data with a printing duty of 100%. These three types of mask patterns are complementary to each other.

Other embodiments using these mask patterns will be explained below. In the printing operation for printing the same printing region by two printing scanning operations in FIG. 14, the mask pattern shown in a1 of FIG. 17 is used in place of the mask pattern shown in b1 of FIG. 12 used in printing the image region [1]-1 by the first scanning. The mask pattern shown in a1 of FIG. 12 used in printing the image region [2]-2 by the second scanning is used in place of the mask pattern shown in b2 of FIG. 12 used in printing the image region [1]-1 by the second scanning. The mask pattern shown in a2 of FIG. 17 is used in place of the mask pattern shown in b3 of FIG. 12 used in printing the image region [1]-1 by the third scanning.

Printing under this condition allows obtaining the same effect as in the first embodiment even when the mask patterns for the two-pass printing mode in this embodiment are used because the maximum printing duty becomes 50%.

Likewise, in the printing operation for printing the same printing region by four printing scanning operations in FIG. 16, the following mask patterns are used. A mask pattern obtained by further thinning out the mask pattern shown in a4 of FIG. 15 to 1/2 is used in place of the mask pattern shown in b1 of FIG. 15 used in printing the image region [1]-1 by the first scanning. The mask pattern shown in a1 of FIG. 15 used in printing the image region [2]-2 by the second scanning is used in place of the mask pattern shown in b2 of FIG. 15 used in printing the image region [1]-1 by the second scanning. The mask pattern shown in a2 of FIG. 15 used in printing the image region [2]-2 by the second scanning is used in place of the mask pattern shown in b3 of FIG. 15 used in printing the image region [1]-1 by the third scanning. The mask pattern shown in a3 of FIG. 15 used in printing the image region [2]-2 by the third scanning is used in place of the mask pattern shown in b4 of FIG. 15 used in printing the image region [1]-1 by the fourth scanning. A mask pattern obtained by further thinning out the mask pattern shown in a4 of FIG. 15 to 1/2 is used in place of the mask pattern shown in b5 of FIG. 15 used in printing the image region [1]-1 by the fifth scanning. The mask patterns which are obtained by further thinning out the mask pattern shown in a4 of FIG. 15 and used in printing the image region [1]-1 by the first scanning and fifth scanning are complementary to each other.

Printing under this condition allows obtaining the same effect as in the second embodiment even when the mask patterns for the four-pass printing mode in this embodiment are used because the maximum printing duty becomes 25%.

Although nonrandom mask patterns are used in the above-described embodiments, the present invention is not particularly limited to them. Complementary random mask patterns with larger sizes may be used.

FIG. 11 reveals that the lower the printing duty, the smaller the number of nozzles in which edge deviation occurs. From this viewpoint, when printing is performed in the multipass printing mode, it is possible to decrease the amount of conveyance of a printing medium as the number of passes of the multipass printing mode increases. FIG. 11 also reveals that the higher the printing duty, the lower the rate of increase in the number of nozzles in which edge deviation occurs. From this viewpoint, it is possible to increase a change in the amount of conveyance of the printing medium as the number of passes of the multipass printing mode increases.

A description of the feature of the present invention will be repeated lastly. According to the present invention, it is possible to execute a first printing mode and second printing mode. In the first printing mode, a normal region as the first printing region is printed by N printing scanning operations and an edge region adjacent to the normal region is printed by (N+1) printing scanning operations. In the second printing mode, the normal region is printed by M (M>N) printing scanning operations and the edge portion is printed by (M+1) printing scanning operations.

For example, it is possible to execute the one-pass printing mode (FIG. 13) in which the normal region is printed by one scanning operation, and the two-pass printing mode (FIG. 14) in which the normal region is printed by two scanning operations. Alternatively, it is possible to execute the two-pass printing mode (FIG. 14) in which the normal region is printed by two scanning operations, and the four-pass printing mode (FIG. 16) in which the normal region is printed by four scanning operations. The width of the edge region in the scanning direction in the second printing mode in which the normal region is printed by M scanning operations is narrower than that of the edge region in the scanning direction in the first printing mode in which the normal region is printed by N scanning operations.

For example, the edge region as the second printing region has a width corresponding to 32 nozzles in the scanning direction if N=1 (FIG. 13), while it has a width corresponding to 26 nozzles in the scanning direction if M=2 (FIG. 14). Also, the edge region as the second printing region has a width corresponding to 26 nozzles in the scanning direction if N=2 (FIG. 14), while it has a width corresponding to 20 nozzles in the scanning direction if M=4 (FIG. 16).

The above-described arrangement allows not only a reduction of deterioration in image due to the presence of an unprinted stripe occurred in the contact portion between successive scanning operations of the printhead but also high-speed printing.

The larger the number of passes of the multipass printing mode, the lower the printing duty of the printhead per scanning. In view of this, a third printing mode which uses a relatively large number of passes (e.g., eight or more passes) may be provided. In the third printing mode, all printing regions are printed by the same number of times of scanning of the printhead without setting an edge region printed by the two edge portions of the printhead.

Although the above-described embodiments have exemplified multipass printing modes when M=1, 2, and 4, the present invention is also applicable to multipass printing modes which use other numbers of passes.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-104210, filed Apr. 11, 2007, which is hereby incorporated by reference herein in its entirety.

What is claimed is:

1. An inkjet printing apparatus comprising:

a printing unit configured to print using a printhead having a plurality of nozzles to discharge ink on a printing medium; and a control unit configured to control the printing unit to print in accordance with any one of a plurality of modes including a first printing mode and a second mode, wherein the first printing mode is a mode in which printing is executed so that both a first region which is completed printing by scanning the printhead N times (N is an integer not less than 1) and a second region which is completed printing by scanning the printhead (N+1) times exist, and the second printing mode is a mode in which printing is executed so that both a third region which is completed printing by scanning the printhead M times (M is an integer not less than 2, and M>N) and a fourth region which is completed printing by scanning the printhead (M+1) times exist, wherein the control unit controls the print unit to print so that:

the second region printed in the first printing mode is printed by scanning the print head (N+1) times including scanning of 2 times by a group of nozzles having an X number of nozzles (X is an integer not less than 2) which are arranged at two ends of the printhead in a direction which intersects a scanning direction of the printhead, and the fourth region printed in the second printing mode is printed by scanning the print head (M+1) times including scanning of 2 times by a group of nozzles having a Y number of nozzles (Y is an integer not less than 1, and X>Y) which are arranged at two ends of the printhead in the direction which intersects the scanning direction of the printhead.

2. The apparatus according to claim 1, wherein N is 1.

3. The apparatus according to claim 1, further comprising a conveyance unit configured to convey the print medium in a conveyance direction which intersects a scanning direction of the printhead, wherein the conveyance unit, in the first printing mode, conveys the printing medium by a width in the conveyance direction of the first region and the second region at an interval between successive scanning operations of the printhead, and in the second printing mode, conveys the printing medium by a width in the conveyance direction of the third region and the fourth region at an interval between successive scanning operations of the printhead.

4. The apparatus according to claim 1, wherein conveyance amount of the printing medium by the conveyance unit in the first printing mode is larger than conveyance amount of the printing medium by the conveyance unit in the second printing mode.

5. The apparatus according to claim 1, wherein a printing region printed by one scanning for the first region is larger than a printing region printed by one scanning for the second region, and a printing region printed by one scanning for the third region is larger than a printing region printed by one scanning for the fourth region.

6. An inkjet printing method including a printing unit configured to print using a printhead having a plurality of nozzles to discharge ink on a printing medium, the method comprising:

printing in accordance with any one of a plurality of modes including a first printing mode and a second mode, the first printing mode being a mode in which printing is executed so that both a first region which is completed printing by scanning the printhead N times (N is an integer not less than 1) and a second region which is completed printing by scanning the printhead (N+1) times exist, and the second printing mode being a mode in which printing is executed so that both a third region which is completed printing by scanning the printhead M times (M is an integer not less than 2, and M>N) and a fourth region which is completed printing by scanning the printhead (M+1) times exist, wherein the printing is executed so that:

the second region printed in the first printing mode is printed by scanning the print head (N+1) times including scanning of 2 times using a group of nozzles having an X number of nozzles (X is an integer not less than 2) which are arranged at two ends of the printhead in a direction which intersects a scanning direction of the printhead, and the fourth region printed in the second printing mode is printed by scanning the print head (M+1) times including scanning of 2 times using a group of nozzles having a Y number of nozzles (Y is an integer not less than 1, and X>Y) which are arranged at two ends of the printhead in the direction which intersects the scanning direction of the printhead.

* * * * *